US007658565B2

(12) United States Patent
Colburn et al.

(10) Patent No.: US 7,658,565 B2
(45) **Date of Patent: *Feb. 9, 2010**

(54) COMBINATION TIRE SIDEWALL PROTECTANT DISPENSER AND APPLICATOR

(75) Inventors: Todd Colburn, La Jolla, CA (US); Frederick Large, Carlsbad, CA (US); Dan Anderson, Carlsbad, CA (US); Wen-Chen Su, Lexington, KY (US); Steven Ruble, Lexington, KY (US); Mark D. Koenig, Lexington, KY (US); Brooke T. Baxter, New Milford, CT (US); William R. Bucknam, Jr., Woodbury, CT (US)

(73) Assignee: Ashland Licensing And Intellectual Property, LLC, Dublin, OH (US)

( * ) Notice: Subject to any disclaimer, the term of this patent is extended or adjusted under 35 U.S.C. 154(b) by 637 days.

This patent is subject to a terminal disclaimer.

(21) Appl. No.: 11/230,835

(22) Filed: Sep. 20, 2005

(65) Prior Publication Data

US 2006/0062629 A1 Mar. 23, 2006

Related U.S. Application Data

(63) Continuation-in-part of application No. 10/437,658, filed on May 14, 2003, now Pat. No. 6,945,722.

(51) Int. Cl.
*A46B 11/00* (2006.01)

(52) U.S. Cl. ..... 401/11; 401/9; 401/186; 401/204; 401/205

(58) Field of Classification Search ..... 401/9, 401/11, 183–186, 203–207; 215/216, 224
See application file for complete search history.

(56) References Cited

U.S. PATENT DOCUMENTS

| | | | | |
|---|---|---|---|---|
| 1,287,487 | A | 12/1918 | Smith | |
| 1,565,608 | A | 12/1925 | Walsh, Jr. | |
| 1,678,962 | A | 7/1928 | Stark et al. | |
| 1,972,318 | A | 9/1934 | Rosenberg | |
| 2,147,769 | A | 2/1939 | Epstein | |
| 2,281,367 | A * | 4/1942 | Moll | 401/272 |
| 2,377,837 | A | 6/1945 | Zimmerman | |
| 2,820,234 | A * | 1/1958 | Rigney | 401/186 |
| 2,946,154 | A | 7/1960 | Bornemann | |
| 3,006,023 | A | 10/1961 | Worthington | |
| 3,087,189 | A * | 4/1963 | Scanlon | 401/11 |
| 3,324,855 | A | 6/1967 | Heimlich | |
| 3,418,059 | A | 12/1968 | Robe | |
| 3,876,314 | A | 4/1975 | Nehring | |
| 4,035,090 | A | 7/1977 | Bavaveas | |
| D245,390 | S | 8/1977 | Hoyt | |

(Continued)

OTHER PUBLICATIONS

Photograph Copy—Quick N' Neat Liquid Wax Applicator, Clean Shot Products, Inc. , Emporia, KS 66801—(5 pages).

*Primary Examiner*—David J Walczak
(74) *Attorney, Agent, or Firm*—Wood, Herron & Evans, LLP

(57) ABSTRACT

A tire applicator for applying treatment fluid to sidewall of a vehicle tire, which is constructed with an applicator head including a dispenser housing having a bottom bearing surface and an applicator pad affixed thereto, and which may be configured to complementally and releasably receive an associated container.

20 Claims, 16 Drawing Sheets

U.S. PATENT DOCUMENTS 4,084,910 A 4/1978 LaRosa
4,148,318 A 4/1979 Meyer
4,183,684 A 1/1980 Avery, Jr.
4,225,254 A 9/1980 Holberg et al.
4,413,743 A * 11/1983 Summers ..... 215/216
4,601,081 A 7/1986 Sutton et al.
4,762,433 A 8/1988 Bergeson et al.
4,779,386 A 10/1988 Harris
4,822,194 A * 4/1989 Simonette ..... 401/207
4,925,327 A * 5/1990 Wirt ..... 401/205
4,983,061 A 1/1991 Demarest
5,064,306 A 11/1991 Gueret
5,122,056 A 6/1992 Barbee
5,159,735 A 11/1992 Owens et al.
5,299,877 A * 4/1994 Birden ..... 401/206
5,307,847 A 5/1994 Pavenick et al.
5,397,194 A 3/1995 Yuan et al.
5,452,961 A 9/1995 Lu
5,454,659 A * 10/1995 Vosbikian et al. ..... 401/207
5,597,255 A 1/1997 Yager et al.
5,755,241 A 5/1998 Cheung
5,775,826 A 7/1998 Miller
5,791,801 A 8/1998 Miller
D405,572 S 2/1999 Bouchez
5,896,616 A 4/1999 Large
5,904,433 A 5/1999 Kay
D416,653 S 11/1999 Silvers
5,987,694 A 11/1999 Large
6,010,268 A 1/2000 Sereg et al.
6,035,806 A 3/2000 Lorenzo
6,092,952 A 7/2000 Eberle
6,095,705 A 8/2000 Phillips
6,135,659 A 10/2000 Ku
D434,525 S 11/2000 Angeletta
6,371,675 B1 4/2002 Hoang et al.
6,425,701 B1 7/2002 Jacobs
D461,279 S 8/2002 Angeletta
6,485,212 B1 * 11/2002 Bomgaars et al. ..... 401/11
6,533,484 B1 * 3/2003 Osei et al. ..... 401/205
6,547,471 B1 4/2003 Tucker et al.
2003/0081983 A1 5/2003 Waddell

* cited by examiner

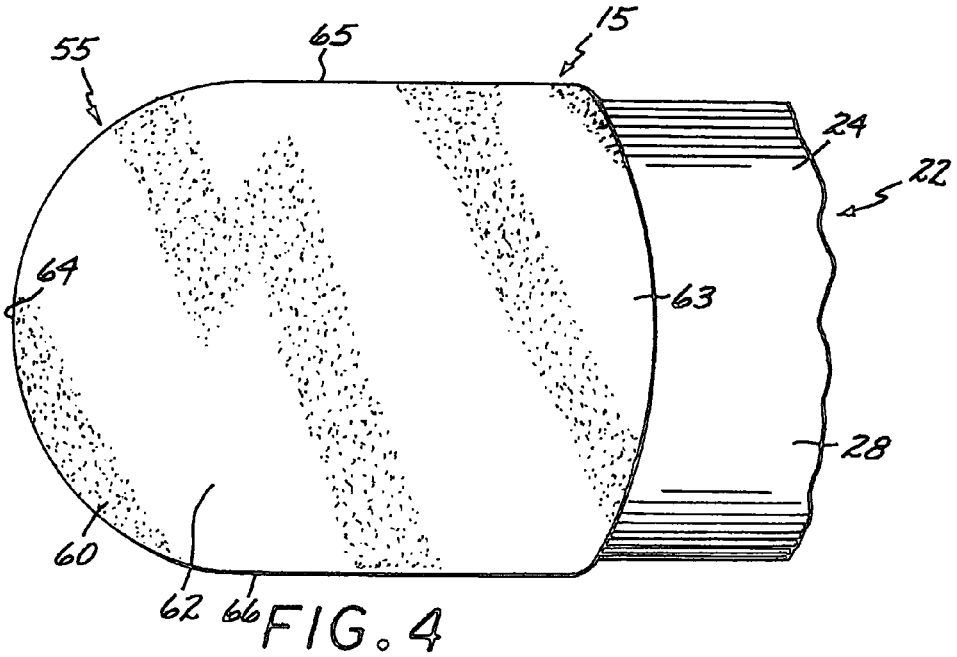
FIG. 4
FIG. 5
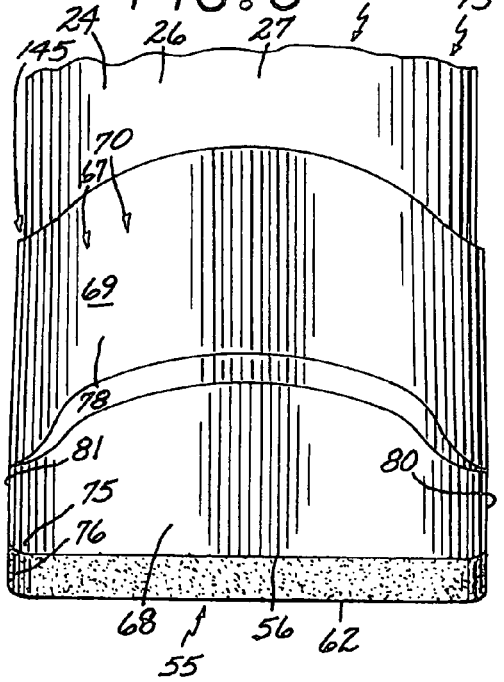
FIG. 6
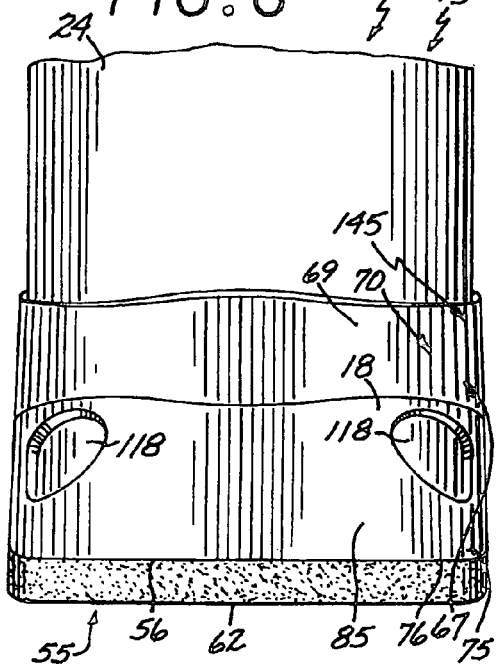

FIG. 9
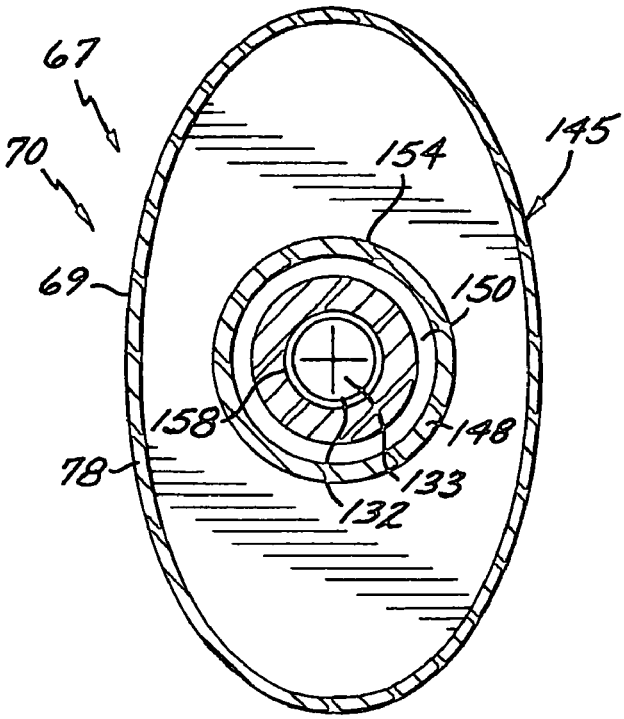
FIG. 10
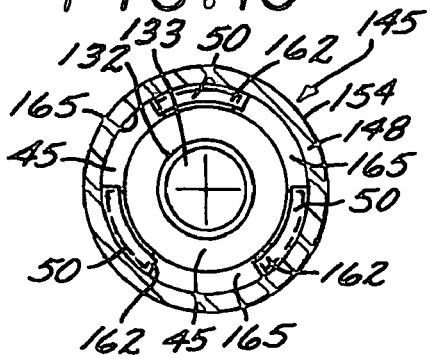
FIG. 11
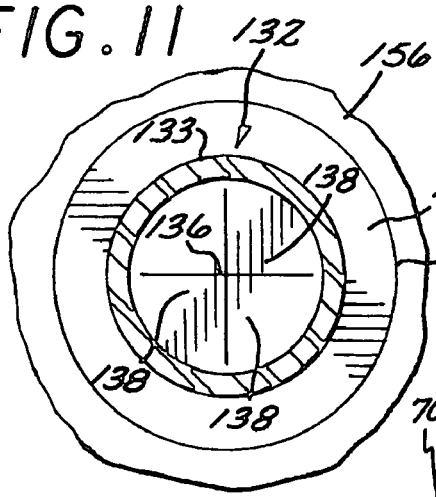
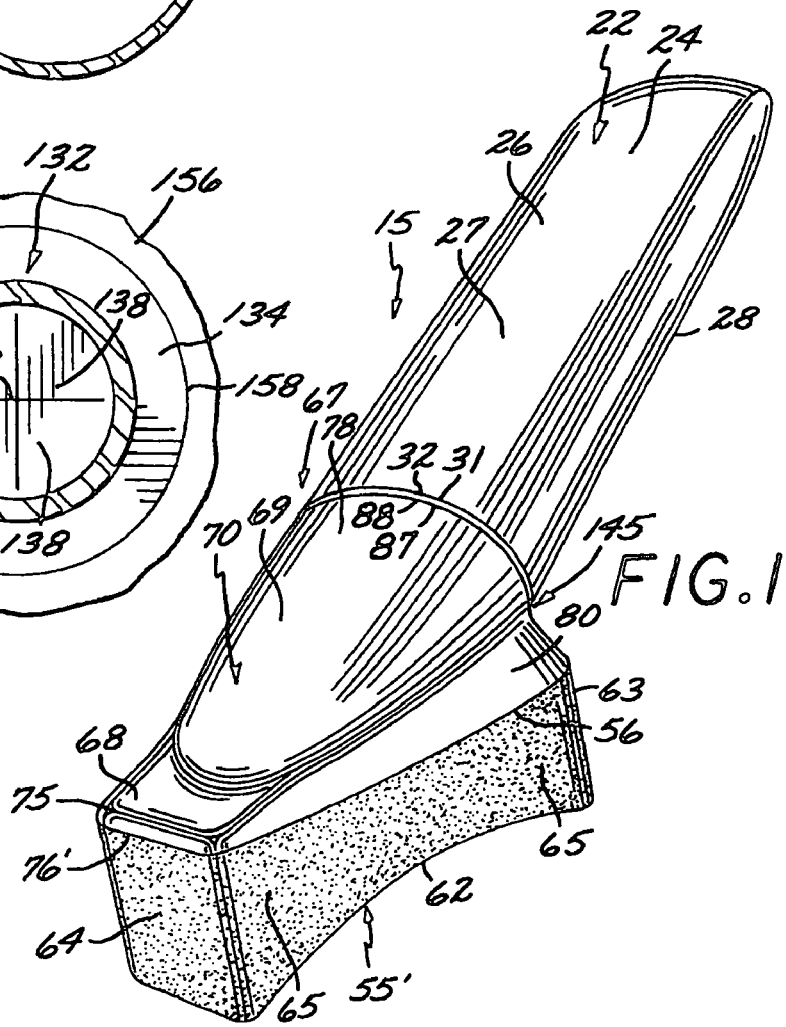
FIG. 12

COMBINATION TIRE SIDEWALL PROTECTANT DISPENSER AND APPLICATOR

CROSS-REFERENCES TO RELATED APPLICATIONS

This application is a continuation-in-part of application Ser. No. 10/437,658, filed May 14, 2003, which issued as U.S. Pat. No. 6,945,722, and on which this application claims priority under 35 U.S.C. § 120.

FIELD OF THE INVENTION

The present invention relates to an applicator device for conveniently and effectively dispensing and applying cleaning fluids or rubber conditioning agents onto a tire of an automobile.

BACKGROUND OF THE INVENTION

Automobile owners often use various liquid compounds to protect and maintain the wheels and tires of their vehicles, or to enhance their exterior appearance. Cleaning compounds and fluids, such as those that may be sprayed onto the tire from a standard spray bottle, have been applied to remove dirt and oxidation from the rubber and condition the tire to increase its luster and aesthetic appeal. Upon application to the sidewall of a tire, such fluids will generally form in small fluid beads on the tire surface, whereupon a user will then spread the fluid across a desired treatment area by a rag, sponge or other similar device. Often times, a user may also apply the treatment fluid directly to the application surfaces of such devices for spreading and applying the fluid to a tire wall as desired. However, these devices will generally quickly become soaked with fluid, and must be discarded, cleaned or laundered after use. Laundering sullied rags is time consuming and expensive, and purchasing new devices for each application can also be expensive and inconvenient.

Such devices are also not easily manipulated, and may cause the fluid contained on their surfaces to come in contact with the hands of a user because they lack a handle separating the applicator surface from the user's gripping hand. After each application of fluid by a simple rag or sponge type device, a user may be required to wash his or her hands, which is inconvenient and inefficient. Further, without a readily accessible resupply of treatment fluid, continuous re-application of fluid directly to the tire wall, or to the working surface of the applicator device for spreading on the tire wall, leads to inefficient expenditure of a user's time and energy. Such devices also are not specifically adapted to conform to the convex surfaces of a tire sidewall, and as a result, may lead to uneven application across the tire's exterior surface.

Some prior art fluid applicator devices have been developed to wash dishes, mirrors and the like with water as shown for example in U.S. Pat. No. 2,820,234 to Rigney. Devices of this type include a housing attached to a fluid container and formed with a disc shaped coupling to receive a stretchable rubber diaphragm mounting a planar plate carrying a mop-head of sponge rubber designed to absorb and hold soap. While such devices may be suitable for washing smooth, flat surfaces such as windows and the like, they do not possess the fluid distribution capability and structural rigidity to independently apply fluid to the variously contoured and curving surfaces of a typical automobile tire.

Other prior art devices have been developed to scrub or clean curved surfaces, such as the curved surface of a toilet seat, by providing for an upstanding handle and a base having a concave curved surface and an absorbent fabric attached to its bottom surface. A device of this type is shown in U.S. Pat. No. 5,159,735 to Owens et al. However, such a thin absorbent fabric is not sufficiently resilient to conform to the varying shapes and sizes of conventional automobile tires, and the device is intended to be disposable after a single use. Also, since the base is configured to fit the curvature of a typical toilet seat, it does not have the proper radius of curvature to complementally fit the sidewall of a tire.

Other prior art devices have been proposed for cleaning tires that incorporate a solid, abrasive block which is used to scrub the rubber of a tire, and is constructed by mixing abrasive particles of stone into a binder which is then molded to form a hard abrasive block. A device of this type is disclosed in U.S. Pat. No. 4,779,386 to Harris. While such a device may be effective for abrasive scrubbing, it is not suitable for spreading a fluid on a tire. The block is not shaped to complementally fit the sidewall of a tire and is not pliable enough to conform to the various curvatures of tire sidewalls. In addition, the hard abrasive surface of this device is not suitable to absorb and evenly distribute a fluid.

Further, while many devices have been developed for spreading a liquid onto surfaces in general, these devices do not address the specific need of spreading cleaners and rubber conditioning agents onto the curved surface of a tire without causing them to come in contact with the gripping hand of a user. Such devices may also not be sufficiently pliable to evenly spread a liquid over rough surfaces, such as embossed lettering or the side tread of a tire. To address these needs, U.S. Pat. Nos. 5,987,694 and 5,896,616, which are assigned to the assignee of the present application, issued to Charles F. Large, a named co-inventor on the present application, proposed a tire protectant applicator configured with a concave curved applicator surface to complementally fit and spread liquid to the sidewall of a tire, which also includes a handle for gripping and a cap for storing the applicator when not in use. While commercially successful, these and other prior art spreader devices require the application of treatment fluid directly to the treatment surface or the applicator's working surface, and do not possess an associated container with a ready supply of treatment fluid or other structural features that distribute and dispense fluid from such a container across the applicator's working surface.

Several prior art devices have proposed the basic concepts of a porous applicator fixably mounted to some type of a container having a reservoir or breakable bladder to hold the fluid to be applied therein. The fluid contained within the container of these devices is absorbed into the porous applicator, and the applicator is then applied to a solid surface to distribute the fluid thereon. Because such devices often lack the requisite capabilities for dispensing controlled amounts of fluid over an extended surface area of the applicator pad, they often simply serve to distribute fluid to a central location on the pad, which may result in a concentration of fluid in its center and an insufficient amount at the forward, rear and lateral extremities thereof. Because the contact or treatment surfaces of the applicator pads of such devices are often not adapted to conform to the convex curvature of tire sidewalls, their use in conjunction with a tire will result in a concentration of fluid dispensed to the central portion of the curved surface without a sufficient application to the remaining portions. In addition, the relatively small surface area of some such applicators may make application to an automobile time consuming and laborious.

Other devices have been developed which employ a pliable porous applicator and a handle which acts as a reservoir to hold a liquid therein. The liquid contained within the handle of these devices is absorbed into the porous applicator, and the applicator is applied to a surface to be treated, thereby depositing the liquid thereon. While these devices are effective for a variety of applications such as applying shoe polish to the surface of a shoe, they are not effective for the specific use of evenly spreading liquid onto the sidewall of a tire. The surfaces of these devices do not conform to the convex sidewall of a conventional automobile tire, and are therefore not effective in applying uniform pressure to uniformly distribute a film on the sidewall of such a tire. In addition, the relatively small surface area of these applicators make application to a tire time consuming and laborious.

In recognition of some of the aforementioned shortcomings, a wax applicator has been proposed which includes a flat applicator plate having a central opening therein and a porous pad mounted thereunder and formed with a centrally disposed communication opening. A cylindrical handle forms a liquid wax receiving container and is formed on one end with a coupling plate. The coupling plate is formed with a central opening alignable with the openings in the applicator plate and pad. A domed valve is mounted over such outlet opening to, upon compression of the walls of the handle, release charges of liquid wax to be dispensed directly to the opening in the pad to the underlying surface to be waxed. A device of this type is marketed under the trademark Quick n' Neat™ by Clean Shot Products Co., Emporia, Kans. Such devices fail to provide for distribution of the dispensed liquid throughout the surface of the applicator pad thus inhibiting efforts to provide for broad, uniform application of treatment fluid, and require a certain degree of dexterity and effort to reach and properly apply treatment fluid to the curved surfaces of a typical automobile tire.

In U.S. Pat. No. 6,945,722, to which the present application claims priority and which is assigned to the assignee of the present invention, a tire fluid applicator device was disclosed that addressed the above described shortcomings of the prior art. For securing the container in the applicator housing, the embodiments addressed therein generally relied, in part, on the inclusion of outwardly projecting studs on the container neck for snapingly engaging behind inwardly projecting lugs formed on the inlet of the housing. While this arrangement has been found to be sufficient for its intended purposes, the present invention focuses, in part, on additional connectivity solutions, including a screw thread engagement and a collar/flange arrangement, that were contemplated but not disclosed in further detail in the parent patent. These connectivity solutions have been found to be reliable and efficient for connecting and disconnecting the housing and container.

In view of the foregoing, an applicator device is needed that can provide for a steady, prolonged and efficient flow of cleaning fluid or conditioner across an extended dimension of the applicator pad, which is also adaptable to assume a curvature that will conform to the convex curving surfaces of a typical tire sidewall while also being sufficiently pliable to conform the varying sizes and shapes of a wide array of vehicle tires. It would also be especially beneficial if the housing that mounts the applicator's pad was designed for rapid and secure mating with a complementally designed replaceable fluid container, which may also serve as a handle, through connection means that provide for efficient and reliable connection and disconnection of the housing and fluid container. The present invention fulfils this need.

SUMMARY OF THE INVENTION

Briefly and in general terms, the present invention is directed to an applicator device for spreading and applying cleaning, rubber conditioning or other treatment fluids to the convex curved surfaces of a vehicle tire. The applicator device includes a flexible wall fluid package, preferably in the form of a container, enclosing a reservoir having a ready supply of treatment fluid that may also serve as a handle by which the user grasps the applicator device.

Joined to the container is a complementally mating applicator head comprising an applicator pad and a dispenser housing including a flow chamber. The applicator pad is affixed or otherwise attached to a bearing surface at the bottom of the housing. In one preferred embodiment, the fluid is transferred through the housing by way of the flow chamber to a distribution surface for delivery to various desired portions on the attachment surface of the applicator pad. In another embodiment, the housing's bottom surface may be defined by a distribution plate, which includes an outwardly facing distribution surface having a distribution channel. This channel facilitates the flow of fluid to various desired portions of the applicator pad and may also or alternatively be correspondingly formed on the applicator pad's attachment surface. In such an embodiment, the distribution may also be achieved by passages or channels formed in a plate or the like sandwiched into the interface between the distribution plate and the pad. In another permutation, the flow chamber works in conjunction with a plurality of dispensing openings arrayed about the distribution plate to dispense the fluid of the container to the applicator's pad for further transfer therethrough to a working surface. In yet another permutation incorporating a distribution plate that defines the bottom surface of the housing, the plate may include a central manifold from which distribution channels extend outwardly and forwardly to distribute the fluid across the width and length of the applicator's pad.

For joining the container to the applicator head, various configurations are contemplated, and in one preferred embodiment, the dispenser housing includes a somewhat funnel shaped, upwardly and rearwardly opening skewed cowling disposed about an inlet device, which includes and coupling shell for releasably receiving the neck of the container by way of a snap lock, bayonet fit, bead and flange, threaded engagement or other appropriate connection. The housing is configured with its cowling and inlet device angling upwardly and rearwardly at a predetermined angle relative to a bearing surface on the bottom surface of the housing such that the elongated body of the container projects longitudinally of the inlet device at the same predetermined angle when the container is coupled to the housing. When so configured, the container, inlet device and flow chamber cooperate to form a fluid communication path therethrough to the applicator pad. A flow control, which in one preferred embodiment is in the form of a one way valve, is positioned at some point along this communication path to regulate the flow of fluid from the container to the applicator pad.

The applicator pad may be dimensioned, contoured and composed of a suitable material to facilitate conforming to a generally concave curvature when it is pressed against the convex curving sidewalls of a variety of vehicle tires. When viewed in plan view, the applicator pad may be configured in a shape similar to that of the bearing surface at the bottom of the housing. In one preferred embodiment, the applicator pad is affixed to this bearing surface at the bottom of the housing, which also may define a concave distribution surface designed for complementally mating with the convex curvature of a tire. In another preferred embodiment, the applicator pad is affixed to the bottom distribution plate at a downwardly facing, concave distribution surface likewise configured to complement the shape of a tire. The pad may be of a generally planar construction, but flexed to curve upon mounting to the concave distribution surface, or may be formed to accommodate the curvature of the distribution surface. In other embodiments, the housing bottom surface or the distribution plate may be generally planar and the applicator pad formed with a concave applicator working surface configured to complementally receive the convex sidewalls of a variety of vehicle tires. It is also contemplated that the applicator pad may be generally planar but constructed to flex and assume a concave and conforming curvature when pressed against the convex curvature of the same variety of tire sidewalls.

In one preferred embodiment, the fluid package may take the form of a container that is disposable and replaceable, being produced in multiple variants adapted to contain any number of specific use tire treatment fluids. However, it is also contemplated that the container may be refillable by a filling stem projecting outwardly from its proximal end.

In still another preferred embodiment seeking to emphasize a comfortable interaction with the hand of the user, the container may be formed with at least an ergonomically adapted dorsal wall defining a palm pad and designed to be complementally received in the user's palm, and may include finger grooves for receipt of the fingers of the user's grasping hand. Also in keeping with the invention, the container may take the form of a squeeze tube or other appropriate structure formed with flexible walls, whereby squeezing of the walls urges the flow of fluid under pressure along the fluid communication path, through the flow control, and to the applicator pad. In another possible aspect of the invention, the container may be formed with rigid walls requiring the user to elevate the container above the level of the dispenser housing to initiate fluid flow through the housing.

These and other features and advantages of the applicator device will become apparent from the following detailed description of preferred embodiments which, taken in conjunction with the accompanying drawings, illustrate by way of example the principles of the invention.

BRIEF DESCRIPTION OF THE DRAWINGS

FIG. 4 is a bottom view of the applicator device shown in FIG. 1;

FIG. 5 is a left hand end view of the applicator device shown in FIG. 1;

FIG. 6 is a right hand end view of the applicator device shown in FIG. 1;

FIG. 9 is a horizontal sectional view taken along line 9-9 of FIG. 7;

FIG. 10 is a horizontal sectional view taken along line 10-10 of FIG. 7;

FIG. 11 is a partial horizontal sectional view, in an enlarged scale, of the flow control mechanism taken along line 11-11 of FIG. 7;

FIG. 12 is a perspective broken view of a second embodiment of the applicator device of the present invention;

DETAILED DESCRIPTION OF THE PREFERRED EMBODIMENTS

Figure 7:
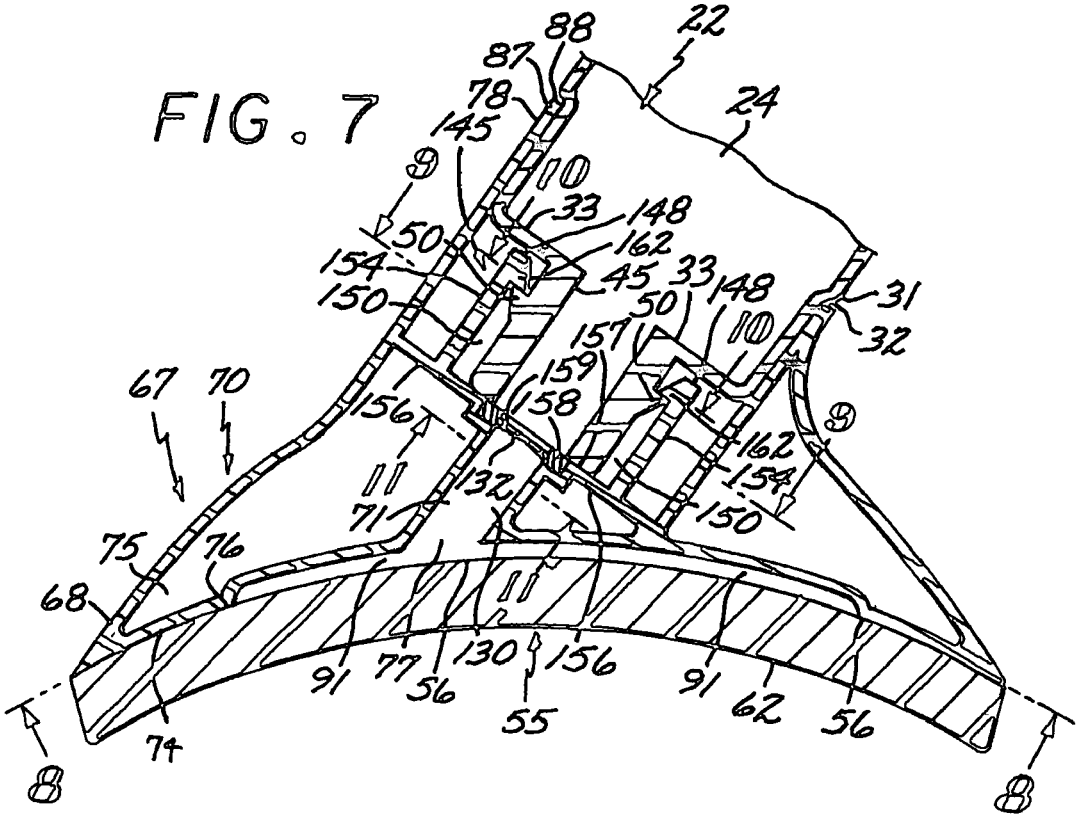
FIG. 7 is a longitudinal sectional view, in enlarged scale, of the applicator device shown in FIG. 1.
Figure 13:
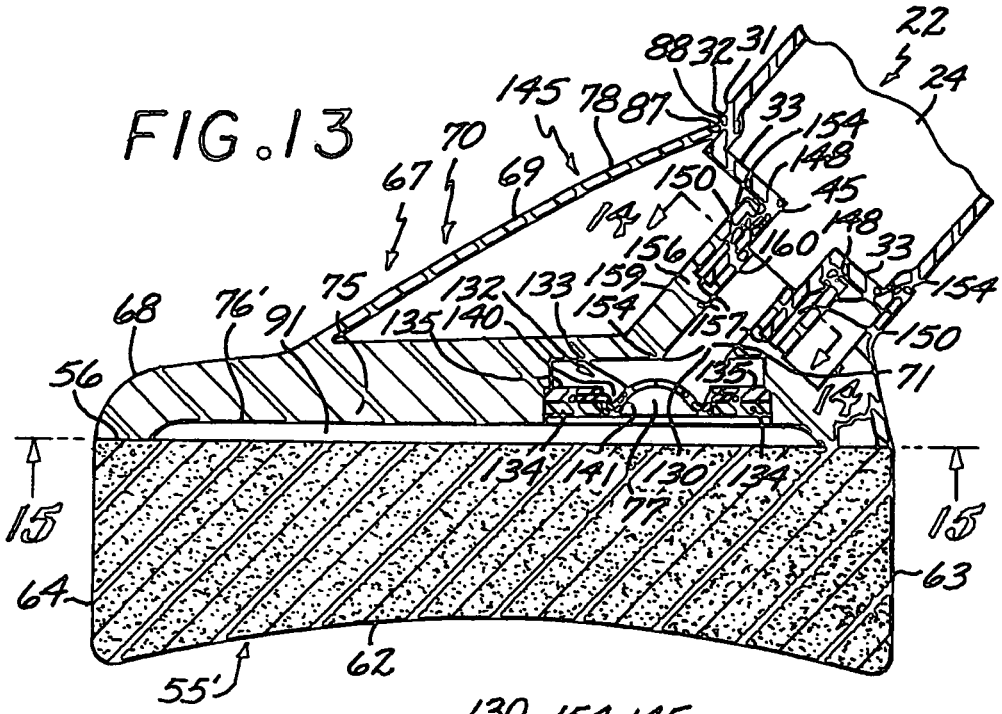
FIG. 13 is a longitudinal sectional view, in enlarged scale, of the applicator device shown in FIG. 12.
Figure 14:
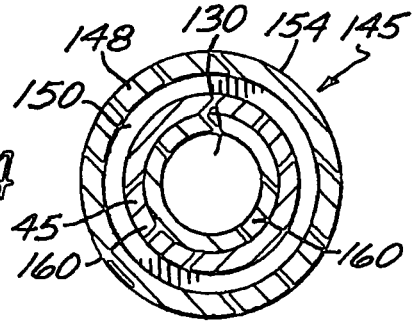
FIG. 14 is a transverse sectional view, in enlarged scale, taken along line 14-14 of FIG. 13.
Figure 20:
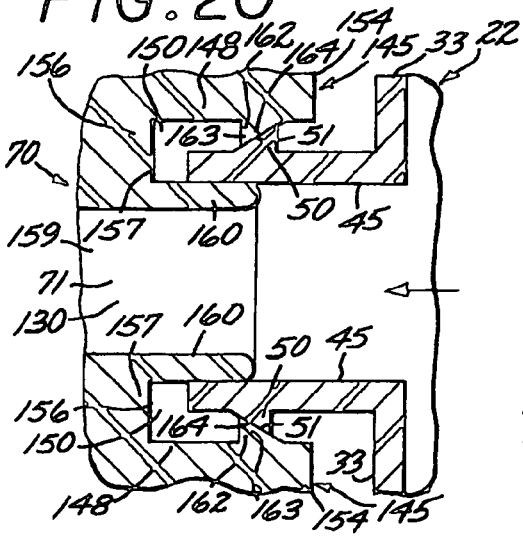
FIG. 20 is a longitudinal sectional view, in an enlarged scale, of a container coupling assembly included in the device shown in FIG. 13.
Figure 21:
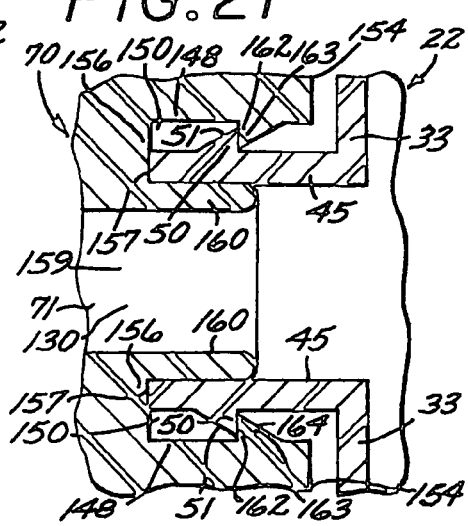
FIG. 21 is a longitudinal sectional view similar to FIG. 20.

Referring to FIGS. 1-3 and 12, the tire applicator device 15 of the present invention includes, generally, an applicator head 67, a dispenser housing 70, an applicator pad 55 and a fluid package, which in a preferred embodiment is in the form of a container 22 that both defines a container reservoir 24 for storing fluid and serves as an elongated handle. The applicator head 67 includes a housing 70 formed with a top and side walls which curve downwardly to terminate in a downwardly facing bottom surface 74. In the embodiment of FIGS. 7 and 13, the bottom surface 74 mounts a distribution plate 75, which includes downwardly facing bearing surface 76. With exemplary reference to the preferred embodiment of FIG. 7, the housing 70 further includes a flow chamber 71 and a container coupling assembly 145 including an inlet device 148 projecting rearwardly from the flow chamber 71 for coupling with the container 22 to secure it to the housing 70. The inlet device 148 may take on any convenient shape or form for transferring fluid therethrough to the flow chamber 71, and includes a coupling shell 154 and a coupling wall 156. Further, in another preferred embodiment, as depicted in FIGS. 13 and 20-21, the inlet device 148 may include a tubular inlet boss 160. With continued reference to the preferred embodiment of FIG. 7, a flow control device, generally designated 132, for metering the flow of fluid to the applicator pad 55 is interposed at some point along a fluid communication path 130 that extends from the container 22 through the inlet device 148 and the flow chamber 71, to deliver fluid to the distribution surface 76 at the housing bottom surface 74 and then to the applicator pad 55 affixed thereto. The pad is mounted to the distribution surface 76 at a pad attachment surface 56 by any appropriate affixation or bonding means as is well known in the art. As set forth in detail below, the pad 55 is further formed with a working surface 62 that is dimensioned, contoured and sufficiently pliable to assume a complemental curvature that will conform to the convex curving surface found in the typical sidewall of a variety of vehicle tires.

Figure 2:
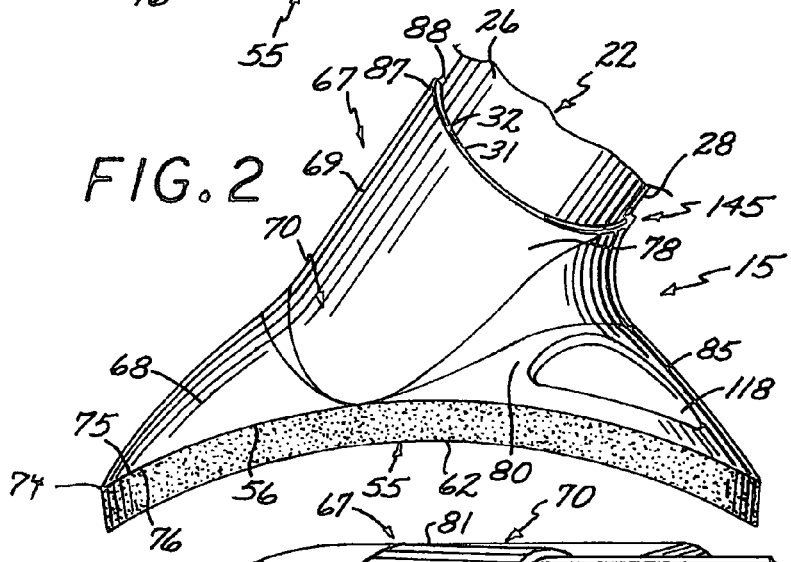
FIG. 2 is a front view of the applicator device shown in FIG. 1.

In a preferred embodiment shown in FIGS. 2 and 7, the distribution plate 75 is configured with a downwardly opening, concave distribution bearing surface 76 to which the attachment surface 56 of the applicator pad 55 is affixed, with the distribution surface 76 being specifically designed to complementally receive the outwardly curving, convex outer surfaces of a wide variety of vehicle tires. However, in another preferred embodiment, as shown in FIGS. 12-13, it is also contemplated that the distribution surface 76' may be generally planar, and that the applicator pad 55' affixed thereto may, for instance, include a working surface 62 that is concave for complementally mating with the outwardly curving, convex outer surfaces of the same wide variety of typical vehicle tires.

Figure 8:
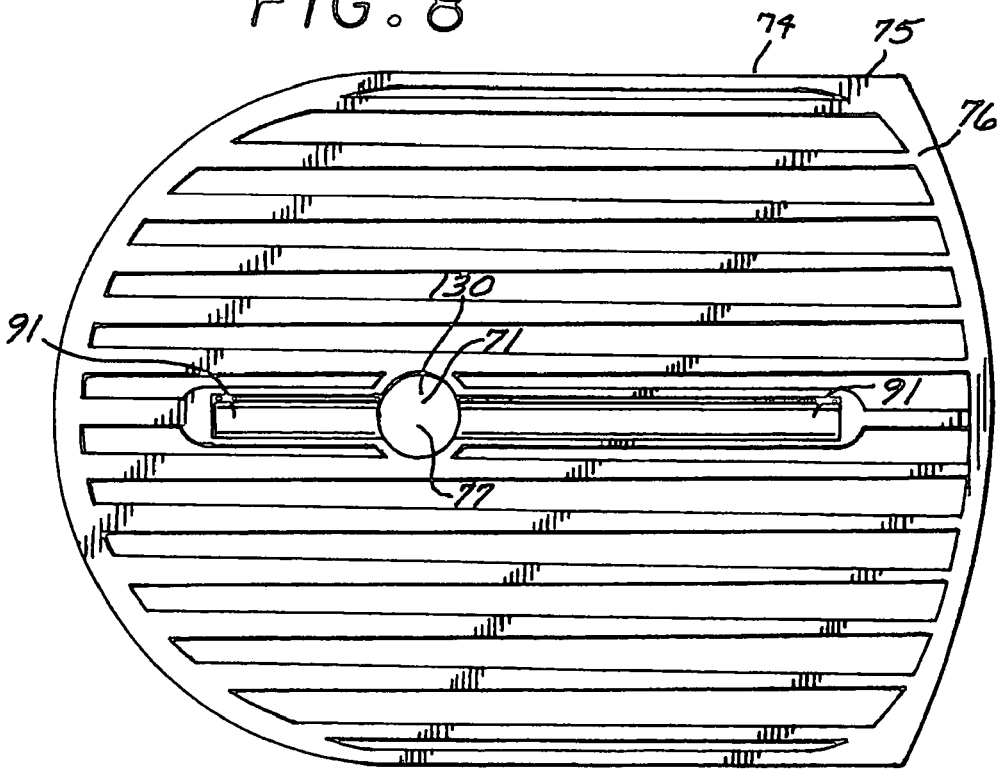
FIG. 8 is a horizontal sectional view taken along line 8-8 of FIG. 7.
Figure 26:
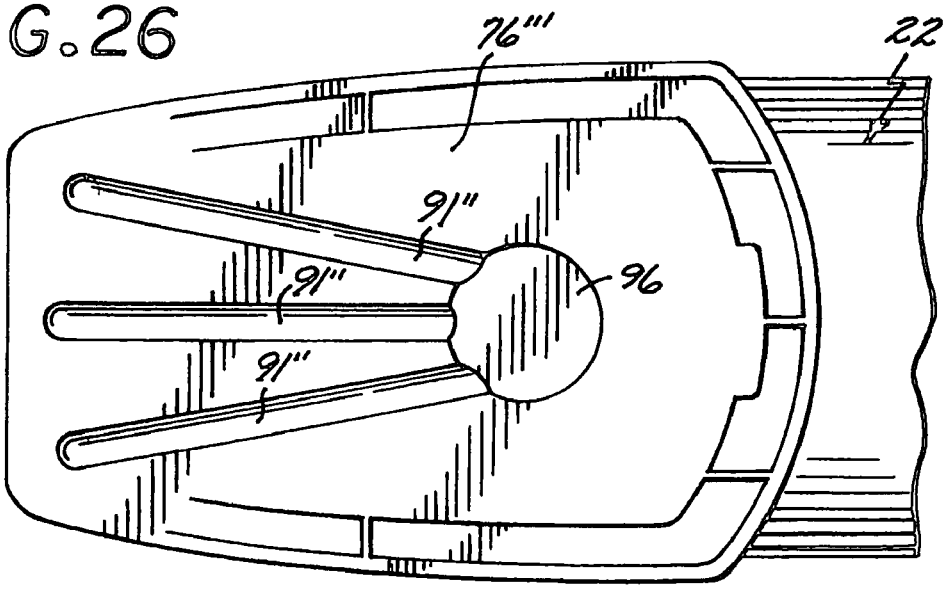
FIG. 26 is a horizontal sectional view of the applicator head of a fourth embodiment of the applicator device of the present invention.

In embodiments incorporating a distribution plate 75, the downwardly facing surface of the plate is formed with a flow distribution capability, which, as shown in FIGS. 7-8, may include at least one distribution opening 77 and at least one longitudinal distribution channel 91. As also shown in the embodiment depicted in FIG. 15, this distribution capability may also include a plurality of distribution branches 92 extending laterally outwardly from the distribution channel or channels 91'. It is contemplated, however, that the distribution capability may take on any number of forms, such as, for example, the distribution plate 75 being formed with a plurality of openings to pass the fluid therethrough, slits formed through the plate or in its bottom surface or a sieve type arrangement in the plate. While the preferred embodiment of FIG. 8 depicts one such distribution channel 91 extending longitudinally along the distribution surface 76, it is also contemplated that the distribution plate 75 or distribution surface 76 may be formed with a plurality of such channels 91 extending across its longitudinal and lateral dimensions, or, as shown in the embodiment of FIG. 26, that a distribution surface 76''' may be formed with a plurality of channels 91'' extending outwardly from a central distribution manifold 96.

Figure 27:
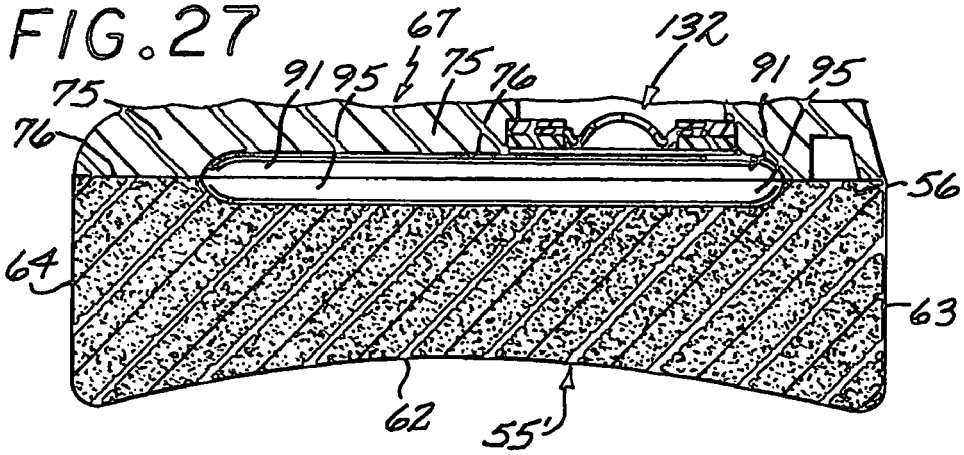
FIG. 27 is a longitudinal sectional view of a modification of the applicator device as shown in FIG. 13.
Figure 28:
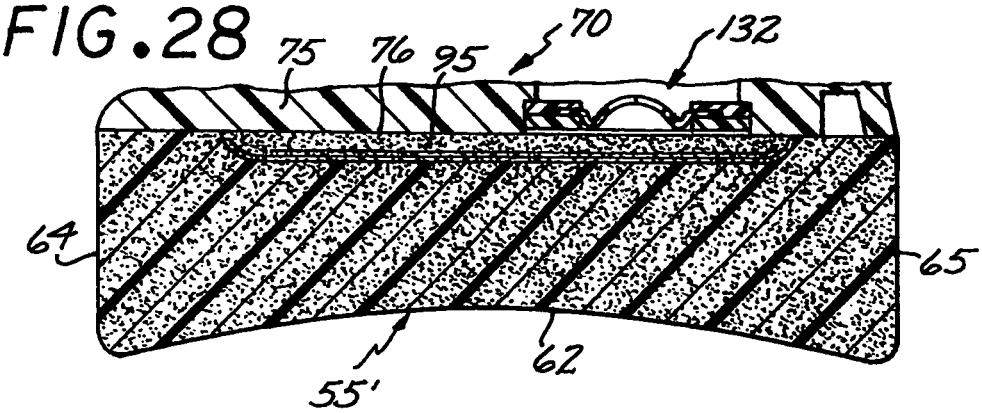
FIG. 28 is a longitudinal sectional view of a modification of the applicator device as shown in FIG. 13.

As shown in FIG. 27, it is also contemplated that the attachment surface 56, on the top side of the applicator pad 55, may also be formed with at least one distribution channel 95 to further facilitate the fluid flow across the attachment surface 56. As shown in FIGS. 27-28, the attachment surface 56 may be formed with such channels 95 to independently (FIG. 28) or, in combination with the channels 91 (FIG. 27), serve as the distribution means. While the distribution channels 91 and 95 are preferably formed in the distribution plate 75 and surface 76 or confronting side of the pad, as will be apparent to those skilled in the art, such distribution may also be achieved by passages or channels formed in a plate or the like sandwiched into the interface between such plate 75 and pad 55.

Figure 15:
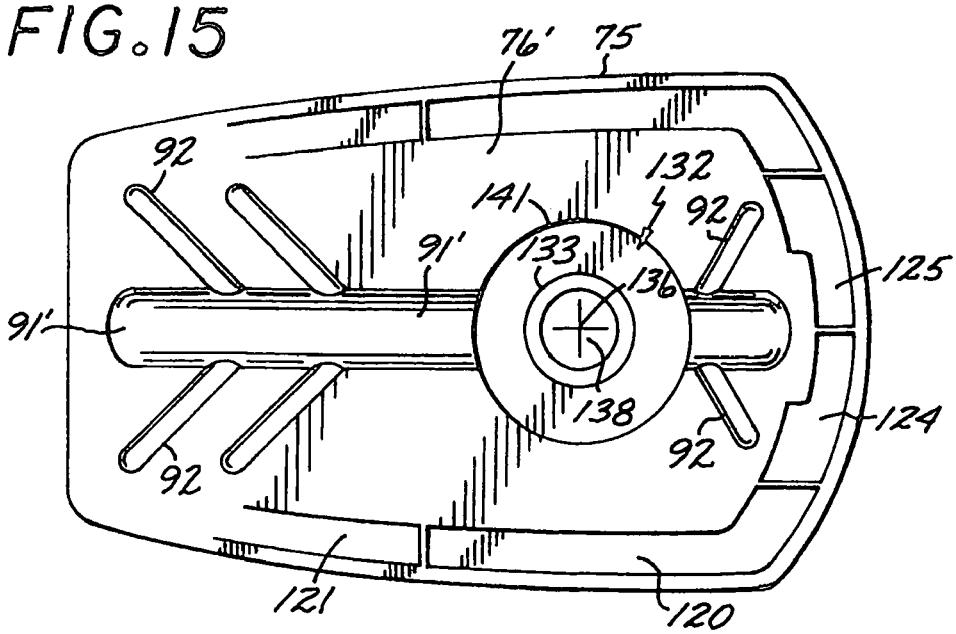
FIG. 15 is a horizontal sectional view taken along line 15-15 of FIG. 13.
Figure 16:
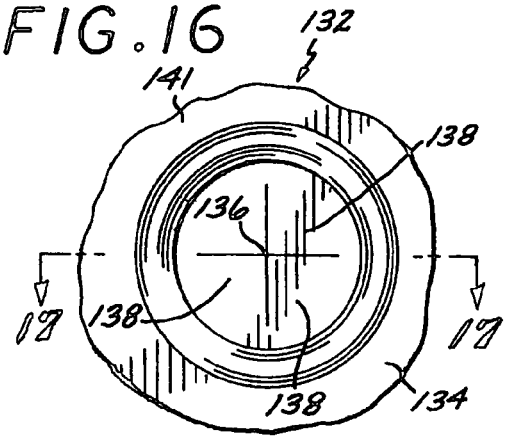
FIG. 16 is a partial horizontal sectional view, in an enlarged scale, of the flow control mechanism shown in FIG. 13.
Figure 17:
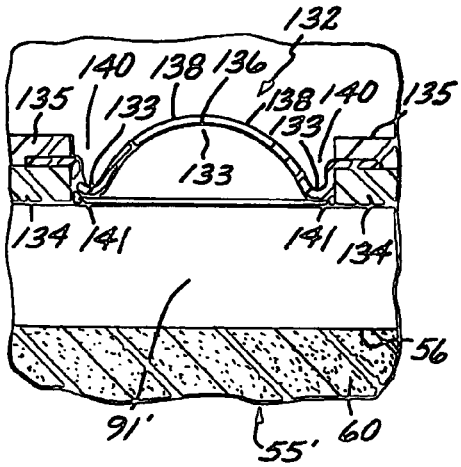
FIG. 17 is a vertical sectional view taken along line 17-17 of FIG. 16.

The exemplary applicator pad 55 is of a semi-open cell foam construction and serves to receive fluid from its top side attachment surface 56 after it passes from the container 22 through the flow control 132 and flow chamber 71, and through the distribution plate 75 and distribution opening 77 if present (see e.g. FIGS. 7 and 13). The density of the semi-open cell pad 55 and the viscosity of the fluid is such as to restrict the rate at which the viscous fluid is dispensed therethough. In practice, as is evident by reference to the exemplary embodiment of FIG. 7, after the fluid is deposited on the applicator pad 55, a portion will flow through the local area of the pad. The remainder of the deposited fluid will pool on the attachment surface 56 and then travel along the distribution channel 91 to be distributed longitudinally along the center of the pad 55, and laterally through the distribution branches 92, as shown in FIG. 15, or other such distribution channels for flowing downward through the pad 55 to the working surface 62, which defines the underside of the pad 55. In one preferred embodiment, as shown in FIGS. 7-8, the downwardly curving shape of the distribution surface 76, and the distribution channel 91 formed therein, permits gravity to assist in distributing the fluid from the local area of the applicator pad throughout its longitudinal and lateral dimensions when the applicator device is positioned in an upright manner.

Figure 29:
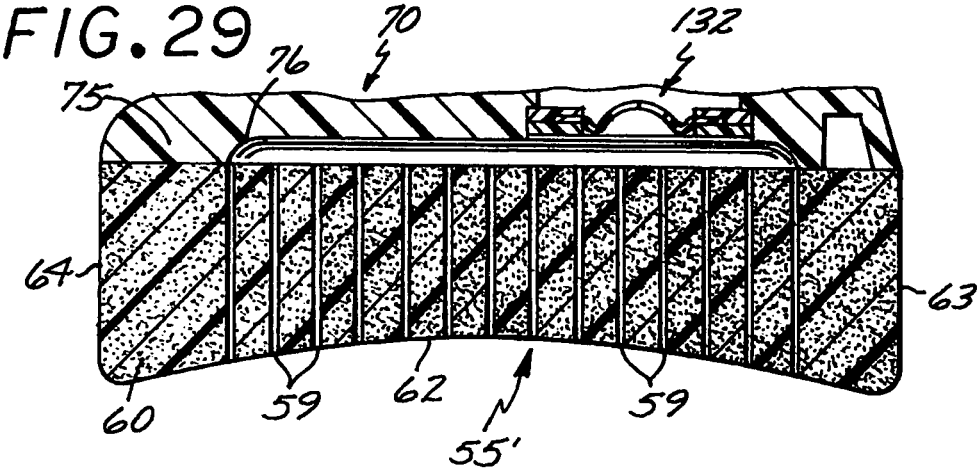
FIG. 29 is a longitudinal sectional view of a modification of the applicator device as shown in FIG. 13.

With reference to the exemplary depiction shown in FIG. 29, it is contemplated that, in order to facilitate the transfer of fluid through the applicator pad 55' to specific strategic locations on the working surface 62, the pad 55' may be formed with through channels 59 arrayed thereabout and extending from the attachment surface 56 to the working surface 62. Such channels 59 facilitate an even distribution to the working surface 62 of the fluid traveling through the distribution channels 91, 92 and/or 95. It is also contemplated that pin holes (not shown) punched in the attachment surface 56 may be situated thereon to promote absorption and flow through the pad 55' at specific desired locations, or that the area of the pad not incorporating a distribution channel may also incorporate through channels 59 for passing fluid from the attachment surface 56 to the working surface 62. Additionally, it is also contemplated that, in order to promote a more rapid transfer of fluid through the pad 55 to desired portions of the working surface 62, such as, for example, on the lateral extremities of the pad, these desired portions may be formed with pre-cut indentations defining a stepped down transverse cross-sectional depth or may be formed from a more porous material than is found in the remainder of the pad 55.

Figure 35:
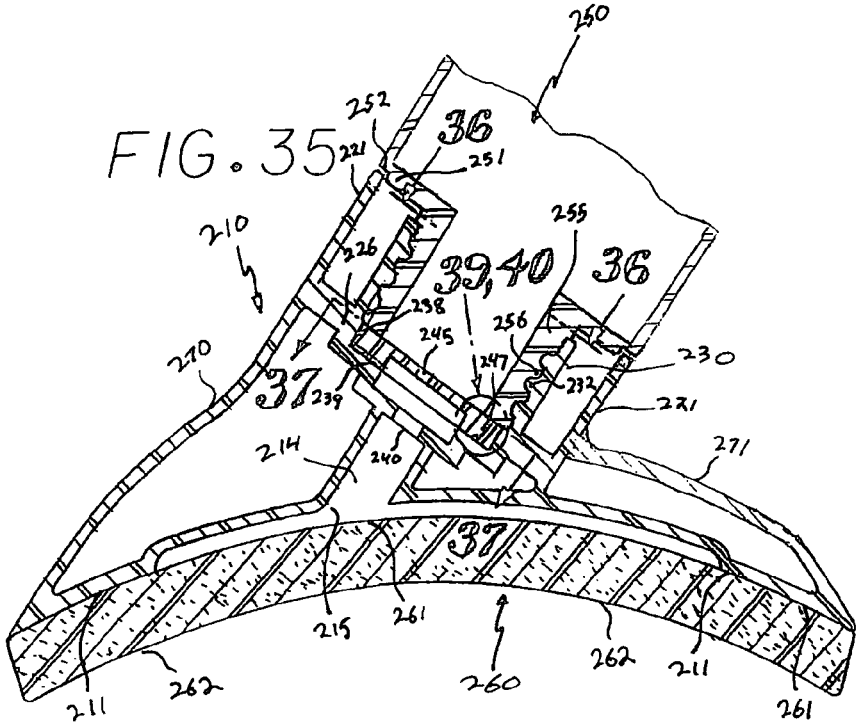
FIG. 35 is a partial longitudinal sectional view, in reduced scale, of the application device depicted in FIG. 32.

The applicator pad 55 may take any convenient shape, and its attachment surface 56 will generally conform in shape and contour to the housing bottom surface 74 and the distribution surface formed thereon. For example, as shown in the embodiments depicted in FIGS. 13 and 22 incorporating a distribution plate 75 or 75', when the distribution surface 76' or 76" is generally planar, the attachment surface 56 of the pad 55' will also be generally planar. However, in the preferred embodiments incorporating a plate 75 configured with a concave curving distribution surface 76, as shown in FIG. 7, or a concave curving bottom bearing surface 211 defining a similarly concave curving distribution surface 215, as shown in FIG. 35, the attachment surface 56 of the pad 55 may be generally planar but will conform to the contour of the distribution surface when affixed thereto. In such an embodiment, it is also contemplated that the pad 55 may be specifically contoured with a convex curving attachment surface 56 to complementally mate with the concave curving distribution surface 76 or 215.

The applicator pad 55 is preferably formed with the working surface 62 being curved in a concave manner to define a saddle shape adapted for engagement with the convex curving surfaces of a typical tire sidewall. This working surface curvature permits a user to evenly spread the desired fluid onto the tire by applying a substantially even pressure across the length of the curved surface. However, it is also contemplated that the pad 55 may be generally planar yet flexile to conform to the convex curvature of the tire sidewall or any concave curvature in the distribution surface. In another embodiment, the pad may be formed such that, in its relaxed condition, the working surface 62 is planar, but with sufficient compressibility so that it may be compressed centrally to thereby conform to the convex shape of the tire sidewall. In such an embodiment, the same even spreading of the fluid is realized when the user engages the applicator head 67 with force directed against the tire's sidewall, which in turn causes the working surface 62 to compress inwardly and assume a generally concave curvature that is complemental to the convex curvature of the tire sidewall.

In a preferred embodiment, the concave working surface 62 of the pad 55 (see e.g. FIG. 13) and/or the concave curving distribution surface 76 or 215 (see e.g. FIG. 7 or 35) has a radius of curvature of approximately 4 inches, however, depending on the desired application, it is also contemplated that a suitable radius of curvature may fall anywhere within the range of 3 to 4.5 inches. This is due to the fact that tires are manufactured in various shapes and sizes, and a curvature radius in this range is suitable for complementally fitting most vehicle tires. Also, the applicator pad 55 is sufficiently pliable to accommodate tires having a somewhat higher or lower profile and correspondingly larger or smaller radii of sidewall curvature. Additionally, while the circumference of a given tire will include varying curvatures, being more squatty and curved at its bottom than at its top, the flexibility of the pad 55 or 55' permits the working surface 62 to effectively engage these varying curvatures on a given tire sidewall.

Figure 1:
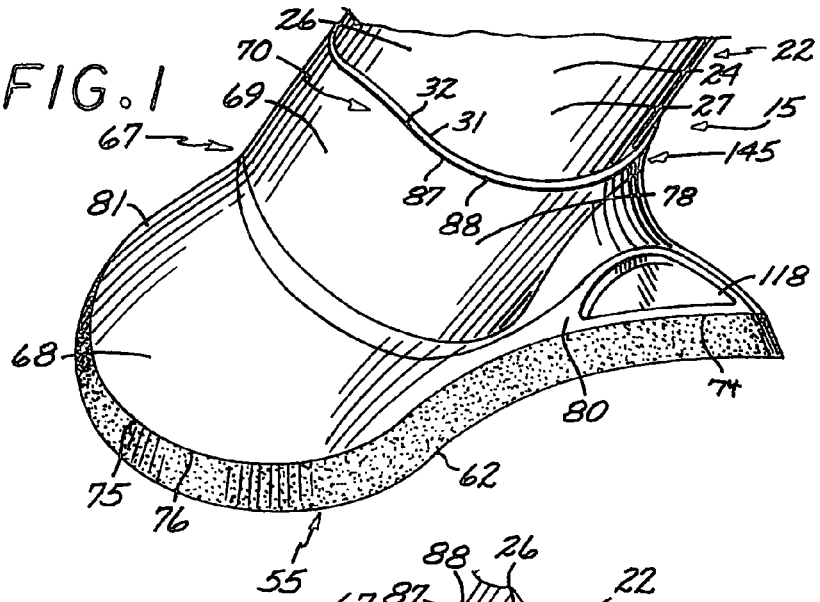
FIG. 1 is a partial perspective broken view of an applicator device embodying the present invention.

As shown in exemplary FIGS. 1 and 2, the applicator pad 55 is configured with the attachment surface 56 to be attached to the distribution surface 76 of the distribution plate 75 at an interface therebetween by one of the many suitable bonding agents or other affixation means known in the art. To this end, in embodiments incorporating a distribution plate, the distribution surface 76 may be formed with a smooth and solid surface, or, in a preferred embodiment, may be formed with any appropriate surface pattern, such as a grid or parallel ridges as shown in FIG. 8, to provide surface area for bonding the attachment surface 56 of the pad thereto. As shown in the alternate embodiment of FIG. 15, the distribution surface 76' may also be conveniently formed along its lateral opposite edges with downwardly opening shallow, blind cavities 120 and 121, which act as lightening holes. The rear edge of the distribution surface 76' may too be formed with a row of laterally projecting downwardly opening lightening cavities 124 and 125. The contours of these cavities, which can also take on any convenient shape, dimension and location, cooperate in defining the distribution surface 76' to which the pad 55' is mounted.

The pad 55 or 55' is preferably constructed in the form of a semi-open cell polymer sponge like material, which can be either formed by injection molding or cut from a stock of foam such as is well known to be suitable in the art. However, while the viscosity of the fluid will influence its rate of flow through the pad, it is contemplated that the pad may be formed of any material conducive to providing a desired level of resistance to prevent rapid fluid transfer therethrough to the working surface 62. For example, it is contemplated that the applicator pad 55 or 55' may be formed with semi-open, open or closed cell foam, or with fibers having similar characteristics, or with bristles, such as those found in a brush, or with a porous flow control screen or wall or any other suitable material or structure for passing fluid therethrough to the working surface 62.

It is further contemplated that the attachment surface 56 of the pad 55 or 55' may correspond generally in shape and surface area to that of the bottom bearing surface 74 to which it is mounted. The material composition, shape and dimensions of the applicator pad are not essential to the present invention, with the fundamental importance of the pad being that it is adaptable to assume a complemental curvature that will conform to the convex curvature of a typical vehicle tire sidewall when the pad is applied thereto. Therefore, the material composition, shape and dimensions of the applicator pad 55 or 55' may be varied to suit a desired application or to work most effectively with the formulation and viscosity of a chosen treatment fluid. In the embodiments incorporating a concave curving distribution surface 76, as for example shown in FIG. 7, a large magnitude of depth in the pad 55 is not required and its depth may be uniform across its length. This is due to the fact that the distribution surface itself is designed to conform with the curvature of the tire's sidewall. Therefore, in such embodiments, the depth of the pad 55 will be relatively lessened in comparison to those embodiments incorporating a generally planar distribution surface, and may, for example, be as thin as ¼ of an inch.

As shown in another preferred embodiment incorporating a generally planar distribution surface 76', such as shown in FIG. 13, it is contemplated that the pad 55' will incorporate a relatively greater depth. For example, as shown in FIG. 12-13, the outer perimeter of the pad may extend downwardly in a transverse orientation to the longitudinal axis of the housing bottom surface 74 to define the saddle shaped, concave curving working surface 62. In such an embodiment, the pad 55' may appear somewhat trapezoidal in plan view, and may include a proximal wall 63, a laterally stepped down distal wall 64, and a pair of laterally spaced apart, gradually inwardly and forwardly curving side walls, 65 and 66. In one possible configuration as shown in FIG. 12, the pad 55' has a depth of about 1½ inches at its proximal and distal walls, 63 and 64 respectively, and a depth of ¾ inch at its center. However, it is contemplated that the depth of the pad at the distal wall 64 may be slightly less than the depth at the proximal wall 63, for example measuring about 1⅜ inches. Additionally, in keeping with the spirit of the invention, the dimensions, material composition and shape of the applicator pad may be varied depending on such considerations as the viscosity of the chosen treatment fluid, the shape of the distribution surface and the radius of curvature of a tire's sidewall.

Turning now to the construction of the housing 70, it may be formed of any convenient and suitable material, but is preferably formed from polypropylene or of any appropriate molded high density plastic, as are known in the art. The housing 70 may further take any convenient shape or form, having, for example, an oval, semi circular or triangular cross sectional shape. In the present invention, the structure of the housing 70, its inner workings and the manner in which it is releasably connected to the container 22 are generally similar in a first embodiment shown in FIGS. 1-11 ("first embodiment" hereinafter) and a second embodiment shown in FIGS. 12-21 ("second embodiment" hereinafter). Therefore, to highlight the construction that is within the scope of the invention depicted in FIGS. 1-21, where the structure of these embodiments is similar, they will be discussed collectively below, and where they differ, these differences will be highlighted by reference to the various figures. The embodiments depicted in the remaining figures will be addressed in further detail after these first and second embodiments.

In the first and second embodiments as shown in FIGS. 2 and 12, the housing 70 is conveniently configured with a shell 69 having outer contours that define a shape generally resembling that of a shoe. The housing is further formed with a nose section 68 and a cowling 78 extending rearwardly and upwardly therefrom, and may include a pair of laterally spaced apart side walls, 80 and 81, extending downwardly from the lateral edges of the cowling 78, and a housing rear wall 85 (FIGS. 2 and 6), angling downwardly and rearwardly from the bottom edge of the cowling 78, which terminate in the downwardly facing bearing surface 74. As shown in FIGS. 1-2 and 6, it is contemplated that either side wall 80 or 81 of the housing 70 may be formed with a lightening cavity 118 or that the side walls may include a pair of oppositely disposed such cavities.

Tapering rearwardly and upwardly from the forwardly disposed nose section 68 (see FIGS. 2 and 12), while angling rearwardly and laterally outwardly, the housing 70 may be formed rearwardly with the coupling assembly 145, which may include the somewhat oval in transverse cross section cowling 78 disposed about the inlet device 148, as shown in FIGS. 7 and 13. With continued reference to FIGS. 1-3 and 12, while it is contemplated that the user will generally gain favorable purchase of the applicator device 15 by grasping the container 22 as a handle, the side walls, 80 and 81, may provide convenient finger pads that permit the user to grasp the device by the housing 70 and cowling 78 when he or she desires to exert a greater and more focused degree of inwardly directed force to a given tire surface.

Figure 30:
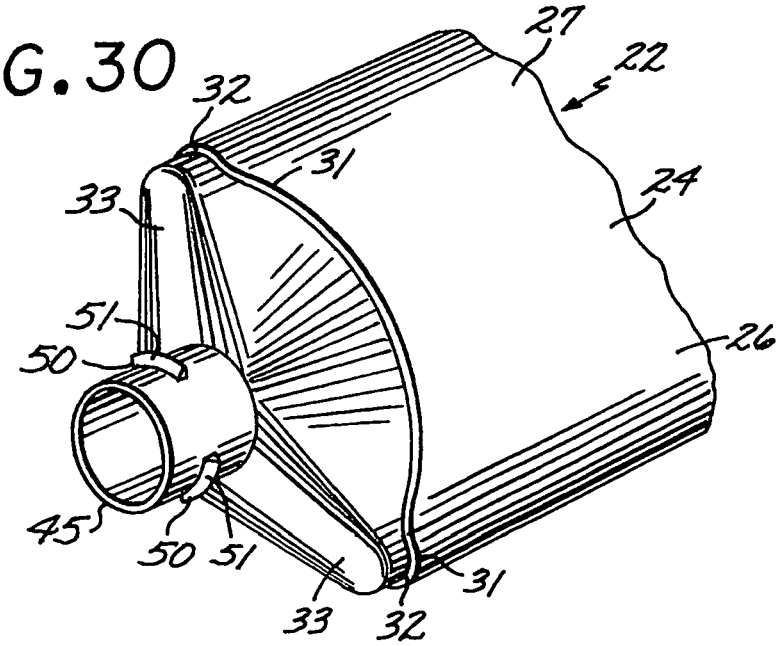
FIG. 30 is a partial perspective view in an enlarged scale, of the container handle shown included in the applicator device as shown in FIG. 12.

With continued focus on the structure of the housing 70, as shown in the first embodiment at FIGS. 1-2 and the second embodiment in FIG. 12, the coupling assembly 145 may include the rearward portion of the dispenser housing 70 and cowling 78, and is adapted to receive the container 22 therein. As shown in FIG. 30, to be received in the coupling assembly 145, the container 22 may include an end wall 31 and a yoke 33 centrally formed with an outwardly extending neck 45. The coupling assembly 145 may be adapted to receive the neck 45 and yoke 33 while mating with complemental surfaces in the end wall 31 of the container. The inlet device 148 of the coupling assembly 145 projects upwardly and rearwardly from the distribution plate 75 or bottom surface 74. While this angle may be set at any value to optimally promote the flow of fluid from the container 22 through the flow chamber 71 to the applicator pad 55, it will preferably fall in the range of approximately 30° to 40°.

As shown in FIGS. 7 and 13, the inlet device 148 extends upwardly and rearwardly from the flow chamber 71, and includes a coupling shell 154 that is disposed about a rearwardly opening cavity 150 for receipt of the neck 45 that projects forwardly from container 22 (see also FIG. 30). While an annular configuration has been depicted for this cavity in FIGS. 9-10 of the first embodiment and FIG. 14 of the second, it is contemplated that the cavity 150 may be of any convenient and appropriate shape for receipt therein of a corresponding in shape container neck 45. As shown in FIGS. 7 and 13, and in more detail in FIGS. 20-21, in both embodiments, the inlet device 148 is proximally formed with a coupling wall 156 that defines an outwardly facing neck abutment surface 157 such that the distal extent of the container neck 45 is abutted thereagainst when the neck is received in the cavity 150. A central opening 159 formed in the coupling wall 156 permits the flow of fluid therethrough and into the adjacent flow chamber 71.

Figure 18:
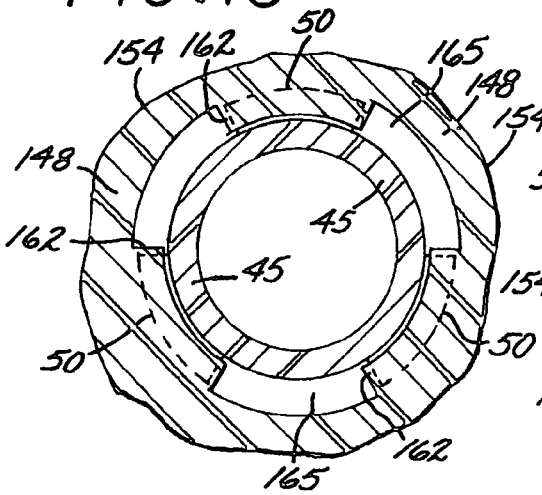
FIG. 18 is a transverse sectional view, in an enlarged scale, of the container coupling mechanism of the device shown in FIG. 13.
Figure 19:
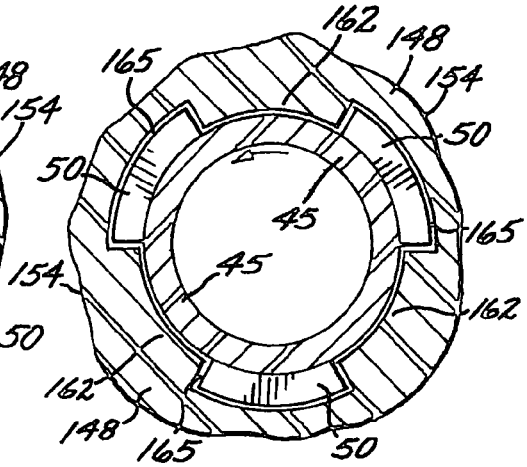
FIG. 19 is a transverse sectional view, in an enlarged scale, of the container coupling mechanism of the device shown in FIG. 13 similar to FIG. 18.

To operate in conjunction with the structure of the neck 45 to releasably connect the housing 70 to the container 22, as shown in FIGS. 7 and 10 of the first embodiment and FIGS. 13 and 18-19 of the second embodiment, the coupling shell 154 is further formed at its distal extremity with a plurality of inwardly projecting lugs 162, which are arrayed thereabout and spaced apart to define respective clearance slots 165 therebetween. For example, in a preferred embodiment depicted in FIGS. 10 and 18-19, three such lugs 162 are spaced annularly equidistantly apart to define three corresponding clearance slots 165 therebetween.

As shown in the second embodiment at FIGS. 13-14 and 20-21, it is also contemplated that the inlet device 148, coupling shell 154, and cavity 150 may be disposed about an inlet boss 160, that projects rearwardly and upwardly from the coupling wall 156. In such an embodiment, when the container neck 45 is received in the cavity 150 and abutted against the neck abutment surface 157, the inlet boss 160 is specifically dimensioned to be received within the neck 45 of the container with the neck disposed thereabouts in a friction fit relationship. So configured, the inlet boss 160 will assist in guiding the fluid flow from the container 22, through the central opening 159 and into the flow chamber 71.

In both the first and second embodiments, with the container 22 releasably received in the housing 70, the neck 45, inlet device 148, flow chamber 71 and distribution plate 75 then cooperate to define fluid communication path 130 therebetween for flow of fluid from the container 22 to the applicator pad 55. Positioned at some point along this fluid communication path 130, a flow control 132 functions to control the flow of fluid therethrough.

As shown in FIGS. 7 and 9-11, in a preferred embodiment, the flow control 132 may be positioned along the fluid communication path 130 adjacent to the distal extent of the container neck 45 when the container 22 is mounted in the housing 70. To accomplish this, as shown in FIG. 7, the coupling wall 156 may be formed with a stepped down cut-out disposed between the neck abutment surface 157 and the central opening 159 that defines a flow control mounting ledge 158, with the flow control 132 being nested therein. While this nesting may be accomplished by a variety of suitable constructions, in an exemplary embodiment as shown on FIG. 17, the flow control 132 includes a pair of mounting rings, 134 and 135, received telescopically in the mounting ledge 158 (see FIG. 7), that mount centrally therein a control valve 133.

While the construction and material composition of the valve 133 may be varied depending on the viscosity of the treatment fluid and the desired flow characteristics for a given application, in a preferred embodiment as shown in FIG. 11, the control valve 133 is a one way flow valve in the form of a flexible polymer sheet configured with a dome having a cruciform slit 136 therein to form diametrical slits oriented at 90° to one another to form triangular leaves 138. Upon application of fluid pressure to the top side thereof, radially inward points of these leaves 138 are flexed downwardly and outwardly to cooperate in forming an opening for downward flow of fluid therethrough along the fluid communication path 130, into the distribution channel 91 and onto the applicator pad attachment surface 56. Upon release of such top side fluid pressure, further flow of fluid through the opening in the valve 133 will be prevented as the leaves 138 return to their original closed configuration.

As shown in FIGS. 13 and 15, in an alternative embodiment, it is also contemplated that the flow control 132 may be positioned within the distribution plate 75. In such an embodiment, the coupling wall 156 is not formed with a flow control mounting ledge 158. Rather, as shown generally in FIGS. 13 and 15 and in greater detail in FIGS. 16 and 17, the distribution plate 75 may be formed with a through bore 140 for communicating with the under side thereof. Such bore 140 is counterbored from the bottom at counterbore 141 for nesting there up into the flow control device 132. The flow control 132 includes a pair of mounting rings, 134 and 135, received telescopically in the counterbore 141, that mount centrally therein the control valve 133.

While a one way valve embodiment has been described, the flow control 132 may take on a variety of forms known in the art, for example a porous disc, duck bill or flapper valve, membrane, other types of valves or any other suitable means for metering the flow of fluid therethrough to a predetermined rate. Also, in the preferred embodiments discussed, the flow control 132 is described as being located in the coupling wall 156 or the distribution plate 75, however, it may be located at any other point along the fluid communication path 130 extending from the container 22 to the applicator pad 55 so long as it functions to control the flow of fluid therethrough. For example, the flow control 132 may also be disposed within the inlet boss 160 of the second embodiment, or situated in the fluid communication path 130 at any point within the flow chamber 71. It is also contemplated that the flow control 132 may be located at the distal extremity of the bottle neck 45, and take the form of any appropriate squeeze bottle type flow control or opening known in the art. Further, the viscosity of the fluid may further influence the chosen construction of the flow control 132, as it is known in the art, for example, that lower viscosity fluids are more likely to be inhibited from flowing through a one way flow type valve than those fluids having a higher viscosity. Thus, it is contemplated that the specific construction of the flow control 132 may also vary depending on the material composition of the chosen treatment fluid to be dispensed therethrough, as is known in the art.

Focusing now on the container 22, as shown in the exemplary embodiment of FIG. 12, it includes a dorsal wall 26, a ventral wall 28 and a end wall 31. The container 22 may be multi-purpose in that the distended, self supporting flexible walls cooperate to define an elongated, somewhat oval in transverse cross section handle, by which the user may gain favorable purchase of the applicator device 15, while also defining a fluid reservoir 24 containing a supply of cleaning or protecting fluid. In a preferred embodiment as shown in FIG. 30, the container 22 also serves as the treatment fluid's package, and may take the form of a squeeze bottle formed of a durable yet resilient plastic to form walls that, in their unflexed configuration, maintain their shape and outward dimensions, but are also compressible inwardly by squeezing to reduce the interior volume to elevate the interior pressure to drive the fluid out into the distribution network. Being self supporting, upon release of the squeezing force, such walls will distend to their unflexed positions, thereby drawing a partial vacuum in the reservoir, providing for atmospheric pressure to force air into the reservoir to cooperate with the residual fluid to occupy the full volume thereof. Therefore, it is contemplated that the container 22 may be formed from a multiplicity of appropriate materials encompassing a wide range of durability and resiliency, as are known in the art. For example, polypropylene, polyethylene, polyvinylchloride and the like have proven to be suitable materials for the container 22. The material composition of the container 22 is sufficiently rigid so that it may also serve as a handle by which a user may grasp the applicator device 15 and exert adequate inwardly directed force to focus and control the application of treatment fluid to a desired tire surface.

It is contemplated that the squeeze bottle container 22 depicted in the preferred embodiment of FIG. 30 may be disposable and replaceable, containing any number of appropriate treatment fluids for application to a vehicle tire. The user may detach the squeeze bottle container 22 from its complementally mating applicator head 67 (see FIG. 12) and discard it when it has exhausted its supply of fluid, while subsequently replacing the discarded bottle with a new and filled bottle. However, it is also contemplated that the squeeze bottle container 22 may be refillable by way of an outwardly and upwardly extending filling stem (not shown) projecting from the vicinity of the rear extremity of the dorsal wall 26. It is further contemplated that such a filling stem may include a snap on containment cap, a screw top or hinged construction or any other appropriate securement means (not shown) to prevent the escape of fluid from the reservoir 24.

Figure 3:
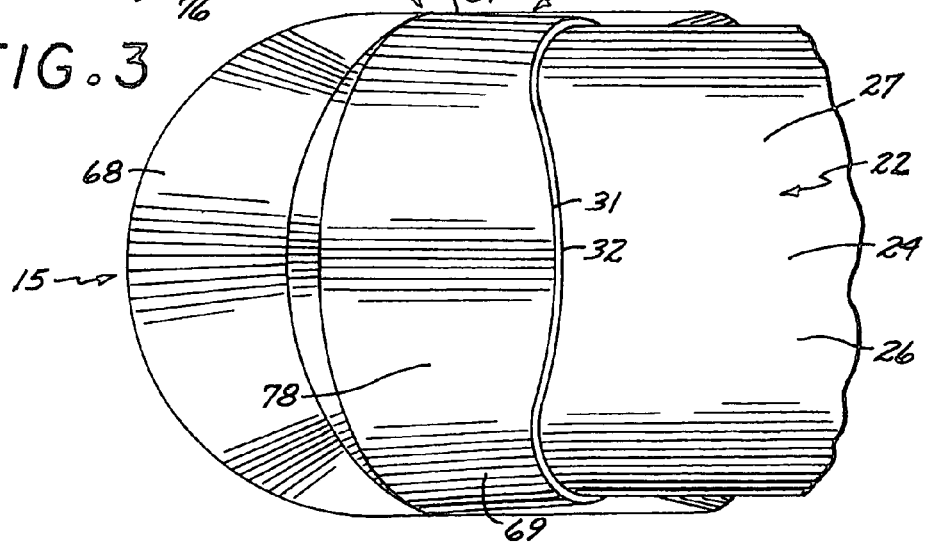
FIG. 3 is a top view of the applicator device shown in FIG. 1.

The exterior surface of the container 22 need not be specifically ergonomically adapted, however, as shown in the exemplary embodiment of FIG. 12, at least the dorsal wall 26 may be shaped and adapted to correspond to the natural curve of a typical user's palm when he or she is grasping the handle 20, while the ventral wall 28 may be similarly shaped and oppositely disposed. In plan view, as shown in FIG. 3, the convex dorsal wall 26 curves gradually outwardly and downwardly to define a palm pad 27 for complemental receipt in the correspondingly concavely curved palm of the user when his or her hand is in a grasping posture. This palm pad provides a pressure surface facing in one direction by which the user may grasp the applicator to exert an appropriate amount of force in the opposite direction for applying treatment fluid to a desired surface. It is further contemplated that other ergonomic features may be incorporated into the container 22 design, to include, for instance, finger grooves (not shown) for receipt of the user's fingers therein.

With focus now on the connection of the container 22 to the dispenser housing 70, they are formed with indexing means to cause the container to be securely registered in the housing. For example, as generally depicted in FIGS. 1-3 and 12, the housing may be formed with a cowling 78 that terminates in its rear edge in a scallop configured on its top and bottom sides with rearwardly projecting curved tongues 87 terminating in respective rearward edges 88. In one preferred embodiment of the container, as shown in FIG. 30, a contoured groove is formed about the periphery of the end container wall 31 to define a forwardly facing contoured shoulder 32 curved on its opposite sides to receive in a nesting relationship the respective tongues 87. As also shown in FIG. 30, the end wall 31 of the container 22 may include a neck yoke 33 that extends outwardly from the lower extent of the shoulder 32 to define the portion of the container 22 that is received within the coupling assembly 145 of the housing 70. The yoke 33 is preferably centrally formed with an outwardly projecting neck 45 to be received in cavity 150 of the inlet device 148 (see e.g. FIG. 7). The neck 45 may take any convenient corresponding shape to that of the cavity 150 for complemental receipt therein, and in one preferred embodiment, as shown in FIG. 30, is internally hollowed along its length and cylindrical in shape. It is also contemplated that a bottle cap (not shown), which may take on a multiplicity of structures known in the art, may be releasably secured over the proximal end of the neck 45 to seal against the unwanted flow or evaporation of fluid from the container reservoir 24. The cap may be secured to the neck 45 by any suitable means as are well known in the art, including, for example, female threading in the cap (not shown) that receives male thread segments formed on the neck 45. A user may remove and discard this cap before mating the container 22 with the dispenser housing 70, or may retain it to be placed back on the neck 45 if the container 22 is removed from the applicator head 67 for storage between applications.

With continued reference to the preferred embodiment of FIG. 30, to enable mounting and locking of the container 22 into the inlet device 148 of the dispenser housing 70, the neck 45 is formed with a plurality of radially outwardly projecting locking studs 50. Such studs 50 are annularly arrayed about the neck 45 and spaced apart and sized to snapingly register behind the corresponding lugs 162 in the inlet device 148 and to fit axially through the clearance slots 165 (see FIGS. 10 and 18-19). As shown in FIG. 30, the studs 50 are further configured at their respective free extremities with outwardly and rearwardly angled cam surfaces 51.

In one exemplary embodiment, as shown in FIGS. 10, 18 and 19, the neck may be formed with three such studs 50 for coupling with three corresponding lugs 162 on the coupling shell 154, which are arrayed equidistant thereabout and spaced annularly apart by a distance to define respective clearance slots 165 therebetween, and to receive axially, in clearing relationship, the respective studs 50. As shown in FIGS. 20 and 21, such lugs 162 are configured with radially out turned teeth 163 defining inwardly and forwardly angled, outwardly facing cam surfaces 164 configured to slidingly engage the cam surfaces 51 of the studs 50 for axial shifting relative thereto and flexing to provide for axial travel sufficient to register the studs 50 behind the lugs 162 in locking relationship as shown in FIG. 21. To releasably connect the container 22 to the housing 70, the bottle neck 45 will be received in the annular cavity 150, and over the inlet boss 160 that may be included in the second embodiment, such that, with the studs 50 engaged securely behind respective lugs 162, the distal portion of the bottle neck 45 will be seated against neck abutment surface 157, as is shown in FIGS. 7 and 13.

So configured, the bottle neck 45 will be securely seated in inlet device 148 in a close fit relationship to provide a fluid tight sealing engagement between the container 22 and the housing 70. As shown in FIGS. 7 and 13, with the rearward edges 88 of the cowling tongues 87 nested against the forwardly facing shoulder 32 of the end wall 31 of the container 22, the neck yoke 33 received in the coupling assembly 145, the neck 45 seated against the abutment surface 157, and the studs 50 registered securely behind respective lugs 162, the container 22 will be securely registered within the housing 70 to hold its rotary position therein.

To release the container 22 from the dispenser housing 70 and its coupling assembly 145, either the cowling 78 and/or the cowling tongues 87 (see e.g. FIG. 2) or the yoke 33 or end wall 31 (FIG. 30), or all of these elements, may be constructed of a material sufficiently flexible to permit sufficient limited axial rotation of the container 22 and the cowling 78 relative to one another to disengage the complemental mating of the forwardly facing shoulder 32 of the container 22 and the rearward edges 88 of the curved cowling tongues 87. This simultaneously rotates the bottle neck 45 within the coupling shell 154 from the position shown in FIGS. 10 and 18, with the studs 50 snapingly engaged behind corresponding lugs 162, until the locking studs 50 are aligned with respective clearance slots 165, as shown in FIG. 19. The user may then withdraw the studs 50 axially through the slots 165 to effectuate a separation of the neck 45 from the inlet device 148. It is also contemplated that, to disengage the container 22 from the housing 70, the cowling 78 and container 22 may be manufactured such that, when the yoke 33 is received in the cowling 78 and the cowling tongues 87 are aligned with the container shoulder 32, there is sufficient clearance between the shoulder and the tongues and the yoke and the cowling to permit limited axial rotation of the container 22 relative to the housing 70.

While a snap lock type connection has been described in connection with the first and second embodiments, it is contemplated that any appropriate connection means, such as a threaded engagement, bayonet fit, flange and bead or a clamp type connection may be employed in the coupling assembly 145 to facilitate coupling of the container 22 to the dispenser housing 70. Additionally, while the container 22 has been shown as including a projecting tubular neck 45 for receipt in the coupling assembly 145 of the housing 70, it will be appreciated by those skilled in the art that the term neck is intended to include any opening in the container, including a recessed tubular element, it only being important that the construction of the neck permit complemental mating of the housing 70 and the container 22.

In operation, it will be appreciated that the subject applicator will typically be sold at a retail level in a package including the applicator head 67 and container 22, possibly along with one or two replacement containers. The replacement containers will typically be closed by a cap (not shown)

releasably connected to the container's neck 45 by any suitable means known in the art. To assemble the applicator device 15, the user will mount a chosen container 22 in the applicator head 67 by generally inserting the yoke 33 and end wall 31 of the container 22 into the coupling assembly 145 of the housing 70. More specifically, the snap lock construction included in the coupling shell 154, as shown in FIGS. 20 and 21, permits the user to seat the container neck 45 in the inlet device 148 in a close fit, fluid tight sealing relationship by inwardly advancing the bottle neck 45 through the cavity 150 within the coupling shell 154, and over the inlet boss 160 if present as in the second embodiment, until the neck studs 50 are snapingly engaged behind respective lugs 162 and the distal extent of the bottle neck 45 is seated against the neck abutment surface 157. This serves to also align the mating curvilinear rearward edges 88 of the cowling tongues 87 with the forwardly facing shoulder 32 of the end wall 31 as shown in FIGS. 1-2 and 12, while the yoke 33 and end wall 31 are seated in the coupling assembly 145 and the neck 45 is received in the inlet device 148 as described above and shown in FIGS. 7 and 13.

When the user undertakes to use the applicator, he or she will grasp the container 22, hold the applicator head 67 down, and either shake such container or exert inwardly directed compressive force on the walls thereof to reduce the volume of the reservoir, applying pressure to the applicator fluid therein to drive such fluid downwardly out of the container neck 45. In the embodiment shown in FIG. 7, the pressure with which the fluid exits the container 22 and the air that is forced from the container will in turn force the fluid through the valve 133 of the flow control 132. As further pressure is applied thereto, the valve's domed shape will be deflected downwardly in the center, thus flaring the proximate corners of the leaves 138 downwardly, thereby opening the slits 136 and providing for a flow of treatment fluid into the flow chamber 71 portion of the fluid communication path 130. The flow chamber 71 may take on any suitable width and shape, depending on the viscosity of the treatment fluid and its flow characteristics, to efficiently direct the fluid downwardly therethrough, and then through the distribution plate 75, distribution surface 76 and distribution opening 77, to be deposited on the attachment surface 56 of the applicator pad 55. Some of the deposited fluid will then begin to flow through the applicator pad. Additionally, due to the downwardly curving shape of the distribution surface 76, the remainder of the fluid will be urged through the channel 91 to flow forwardly and rewardly therein, as shown in FIGS. 7 and 8, so that fluid is distributed across the longitudinal dimensions of the applicator pad 55. The porosity or material composition of the pad will then facilitate the passage of the fluid from the pad's attachment surface 56 to the working surface 62. In embodiments such as shown in FIG. 15, the fluid will also flow through the channels 92 to be distributed across the lateral dimensions of the pad before passing therethrough to the working surface.

In the embodiment shown in FIG. 13, wherein the flow control 132 is situated in the distribution plate 75, after pressure applied to the container 22 drives the fluid downwardly out of the container neck 45, it will travel along the fluid communication path 130 and downwardly into the flow chamber 71. In this regard, it will be appreciated that the by pointing the housing 70 downwardly, the fluid will flow into the flow chamber 71 and along the communication path 130, which will apply pressure to the flow control valve 133. With the flow chamber 71 filled, along with the inlet boss 160 if present in the embodiment, by compressing the walls of the container 22 and reducing the volume therein, pressure will be applied to the fluid in the flow chamber 71, thus tending to force it downwardly through control valve 133 disposed in the distribution plate 75 (FIG. 13). As further pressure is applied thereto, the valve's domed shape will be deflected downwardly in the center, thus flaring the proximate corners of the leaves 138 downwardly, thereby opening the slits 136 and providing for a flow of treatment fluid downwardly through the distribution plate 75 and distribution surface 76' to the applicator pad attachment surface 56. A portion of the deposited fluid will then begin to flow through the applicator pad 55', while the remaining fluid begins to flow through the channel 91' to flow forwardly and rearwardly therein, as shown in FIG. 15, and laterally through distribution branches 92, so that fluid is distributed across the lateral and longitudinal dimensions of the applicator pad 55' for passage therethrough to the concave working surface 62.

Figure 25:
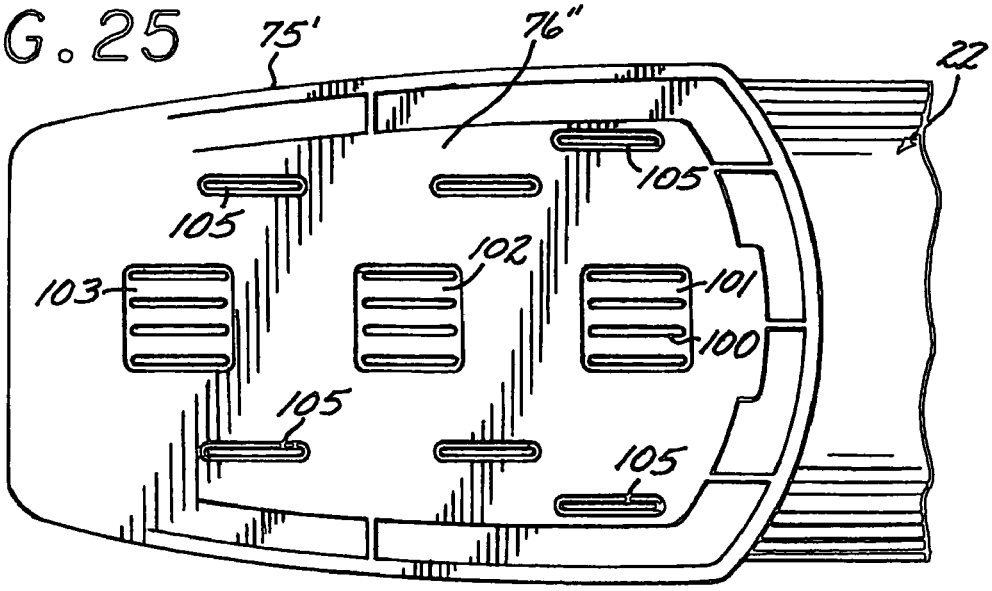
FIG. 25 is a horizontal sectional view taken along line 25-25 of FIG. 22.

As shown in FIG. 25, the user will then grasp the container handle 22 to gain favorable purchase of the applicator 15 and may move the handle as desired to pass the head 67 of the applicator 15 across the convex curving surfaces of a tire, thus applying fluid reaching the underside working surface 62 to the tire's sidewalls. The handle container 22 serves to extend the reach of the applicator 15. While the dimensions may be varied, in practice, the applicator head 67 is about 3½ inches long and the container 22 is about 6 inches long to provide an overall axial reach of over 9 inches. By grasping the container 22 and engaging the concave working surface 62 of the applicator pad 55 with the convex curving surfaces of a tire, and by thrusting the tapered head axially or in a circular motion along the tire's sidewall, the operator may conveniently access and efficiently apply fluid evenly across a desired curving tire surface. In embodiments wherein the working surface 62 of the pad and/or distribution surface 76 are generally planar, the user will engage the working surface 62 with the convex curving tire sidewall and press the working surface inwardly towards the tire, which in turn will cause the pad to flex and cooperate with the working surface 62 to conform to the shape of the convex curving sidewall. This will permit the user to evenly spread the desired fluid onto the tire by applying a substantially even pressure across the length of the curved sidewall surface.

It will be appreciated that, when the pad 55 is engaged with the tire sidewall, that the user may exert further pressure on the applicator head 67 to facilitate the tendency to force the liquid through such pad 55 to the working surface 62 and to the tire sidewall. It will also be a appreciated that, if the user wishes to apply focused and more concentrated perpendicularly directed force to the pad 55 or 55' for hard to clean or treat tire surfaces, he or she may grasp the applicator 15 by the dispenser housing 70 from the top side thereof, applying the palm of his or her hand to the domed surface of the cowling 78 and housing shell 69. The user may also grasp the side walls, 80 and 81, with the fingers of his or her grasping hand being comfortably positioned therealong. When the initial charge of fluid dispensed has been depleted, the user may thereupon again squeeze the container 22 or otherwise repeat the above described sequence.

When the procedure is completed, the user may easily disconnect the container 22 from the dispenser housing 70 and coupling assembly 145 by twisting the container 22 to rotate container end wall 31 within the cowling 78. The flexibility of the cowling, curved tongues 87 and/or yoke 33 and end wall 31 will permit limited axial rotation to skew the alignment between the end wall 31 of the container 22 and the curved tongues 87 of the cowling 78, thereby disengaging the forwardly facing shoulder 32 of the container 22 from the rearward edges 88 of the tongues 87. This simultaneously permits the user to similarly axially rotate the neck 45 slightly within the coupling shell 154 and cavity 150 from the position shown in FIG. 18, with the studs 50 snapingly engaged behind respective lugs 162, until the locking studs 50 are aligned with respective clearance slots 165, as shown in FIG. 19. The user may then withdraw the studs 50 through the slots 165 to disengage the neck 45 from the inlet device 148 and the yoke 33 from the coupling assembly 145 to effectuate a separation of the container 22 from the housing 70.

A cap (not shown) may then be replaced on the neck 45 of the container 22 to be stored until the next use, and, if desirable, the applicator pad 55 may be cleaned or washed in a cleaning fluid, such as tap water. The container 22 and applicator head 67 may then be readily assembled for the next usage, or when the fluid in such container becomes diminished, the container 22 may be discarded and a new replacement container 22, already charged with a desired fluid, may be selected and secured in the dispenser housing 70 as set forth above. It is contemplated that the user may replace the depleted container with another container having the same, or a different, cleaning, rubber conditioning or other tire treatment fluid.

Figure 22:
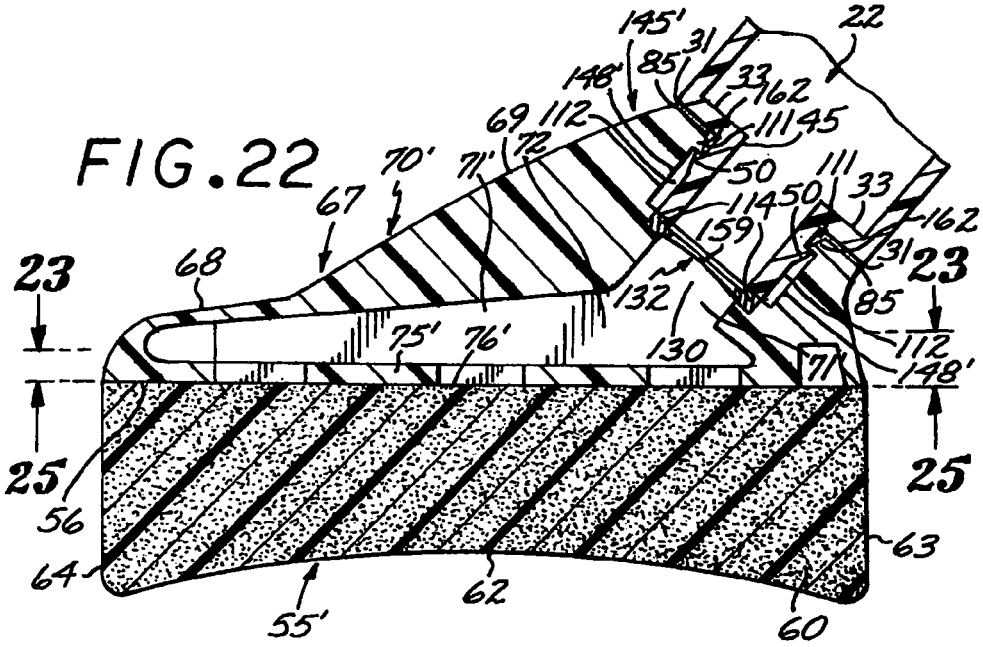
FIG. 22 is a longitudinal sectional view of a third embodiment of the applicator device of the present invention.
Figure 23:
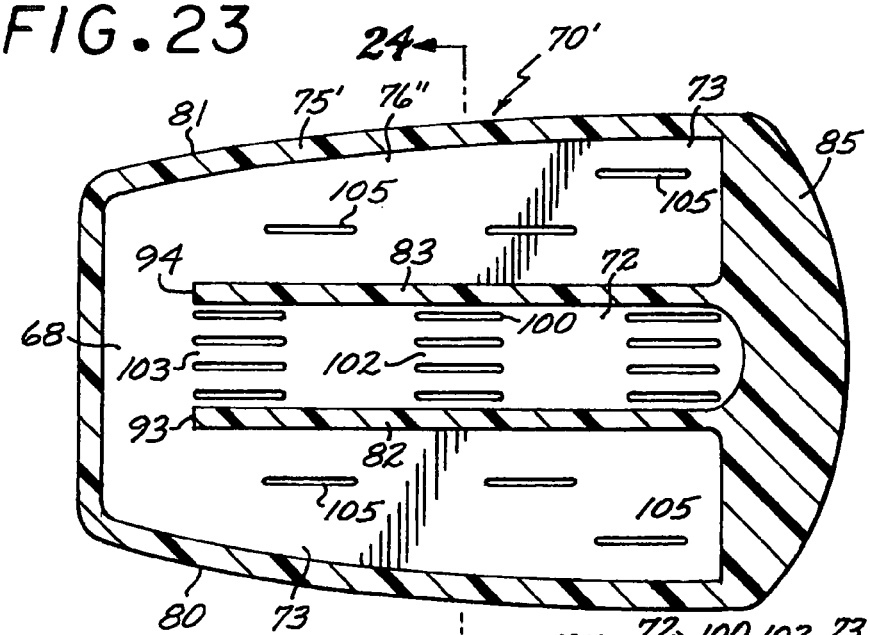
FIG. 23 is a horizontal sectional view of the applicator device shown in FIG. 22 taken along line 23-23 of FIG. 22.

Turning now to an alternate embodiment as depicted in FIGS. 22-25, it is also contemplated that the bottom bearing surface 74' may be formed with a distribution plate 75' that includes a plurality of through flow openings 100 arrayed across the longitudinal and lateral extent thereof. As shown in FIGS. 22 and 23, in such an embodiment, a housing 70' is formed with a flow chamber 71'. The flow chamber 71' may also include a multiple chamber internal construction, being divided into a plurality of chambers, for example two, or, in the embodiment depicted in FIG. 23, a central introduction chamber 72 may be disposed between a pair of flanking chambers 73. However, it is also contemplated that the fluid may pass through the flow chamber 71' to a distribution manifold (not shown), which in turn distributes fluid to a plurality of transfer channels for distributing the fluid across the dimensions of the attachment surface 56 for further transfer through the applicator pad 55' to its working surface 62.

With continued reference to the embodiment depicted in FIG. 23, in a tripartite multiple chamber embodiment, the flow chamber 71' may be configured with a pair of elongated laterally spaced apart ribs, 82 and 83. In this embodiment, the housing 70' includes a rear wall 85, and the ribs, 82 and 83, emanate from the rear wall 85, projecting forwardly to form the centrally disposed introduction chamber 72 and to terminate at their respective forward extremities in respective outlet edges 93 and 94. Within the flow chamber 71', these ribs, 82 and 83, not only define the lateral extent of the introduction chamber 72, but their lateral edges also define the inner walls of a pair of laterally spaced apart flanking chambers 73 having the introduction chamber 72 disposed therebetween. The top surface of the distribution plate 75' defines the bottom surface of the flow chamber 71' and any other chambers included therein.

In the embodiment depicted in FIG. 22, the introduction chamber 72 angles downwardly and forwardly from the proximal extremity of the housing 70' to terminate near the distal extremity, but may extend in any appropriate angle or configuration to facilitate the desired distribution of fluid through various locations in the distribution plate 75'. While fluid distribution to the distribution plate 75' will generally be influenced by the pressure created by inwardly directed compressive forces on the walls of the container, the longitudinal alignment of the introduction chamber 72 may also influence the flow path of the fluid to the distribution plate 75'. For example, a greater downward and forward angling introduction chamber 72 permits the fluid to flow more to the distal extremity of the housing 70', while a lesser downward and forward angling permits the fluid to flow more predominantly to the vicinity of the proximal extremity.

With reference to the embodiment of FIG. 23, the distribution plate 75' is formed with selected arrays of flow openings 100, which are strategically placed to distribute a metered and relatively predictable amount of treatment fluid therethrough to the applicator pad 55'. In FIG. 23, the openings appear as elongated slots 100, but may take any convenient shape or dimension to accommodate the material characteristics of the product being dispensed or the contours of the desired tire surface. For instance, more viscous fluids will require larger openings.

A plurality of slots, generally designated 100, are arrayed in the distribution plate 75' and may be grouped in a first, second and third set of longitudinally spaced apart slots, 101, 102 and 103 respectively, which are generally situated in the introduction chamber 72 near the central region of the dispenser housing 70'. As will be appreciated by those skilled in the art, such relatively closely spaced and clustered slots, as shown in FIG. 23, are so configured to provide for the dispensation of a relatively robust quantity of fluid located generally centrally over the applicator pad 55' in the wider area thereof so as to afford a relatively robust quantity of dispensed fluid in that wide area for distribution and application to the desired tire surface. The flanking chambers 73 may be formed with a plurality of slots 105 for providing for a relatively more modest flow of fluid in the lateral portions of the wider segment of the applicator pad 55'. It is contemplated that in one preferred configuration, these slots may be approximately 1/16" wide and 3/8" long for optimal use in conjunction with a commercially available multi purpose tire treatment fluid sold by Eagle One Industries, of Carlsbad, Calif., under the trade designation WET Tire Shine™. Other suitable treatment fluids may require appropriate adjustment in the dimensions of the slots 100 for optimal flow characteristics therethrough based on the material composition of the selected fluid.

Figure 24:
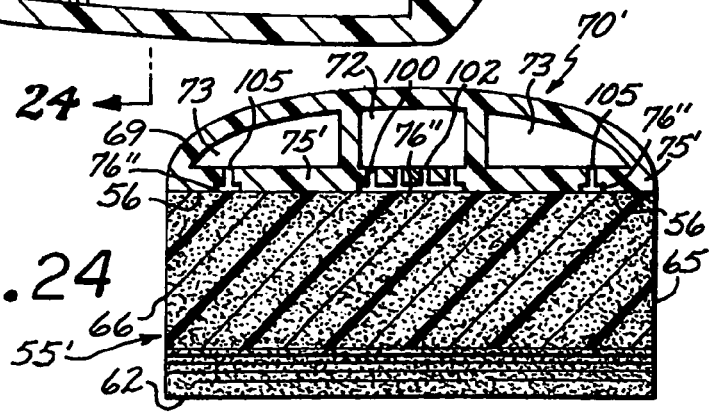
FIG. 24 is a transverse sectional view taken along line 24-24 of FIG. 23.

The distribution plate 75' may be formed such that the openings 100 extend from the upper surface of the plate and terminate at a distribution surface 76". In such an embodiment, the applicator pad attachment surface 56 is strategically connected to the distribution surface 76" throughout its surface area by adhesive or other suitable affixation means known in the art, ensuring that the affixation means does not clog or otherwise occlude the openings 100. To further ensure that the openings will not be occluded by the adhesive or other affixation means, the distribution surface 76" of the distribution plate 75' may be recessed, as shown in FIGS. 24 and 25, so that the openings 100 terminate in the distribution surface 76" of the distribution plate 75' at a point spaced apart from and above the pad attachment surface 56. It is further contemplated that the outer perimeter of the bottom surface of the distribution plate 75' may be formed with a downwardly projecting mounting ridge (not shown) for affixation of a corresponding in area portion of the perimeter of the applicator pad attachment surface 56 thereto.

With focus now on the internal construction of the housing 70' in the alternate embodiment shown in FIG. 22, it is also keeping with the invention that the rear dispenser housing wall 85 may be formed with a coupling assembly 145' including a mounting socket 111 for complemental mating with the yoke 33 and neck 45 of the container 22. The mounting socket 111 is formed with an inlet device 148' including a tubular inlet bore 112 that extends forwardly and downwardly through the rear wall 85 and maintains fluid communication with the flow chamber 71'. The inlet bore 112 is formed with at a bore abutment ridge 114 extending inwardly from the walls of the bore 112 and defining a transition between the distal extent of the inlet bore 112 and the proximal extent of the flow chamber 71'. In FIG. 22, the flow control 132 is depicted as being located at this transition, however, it may be located at any point along fluid communication path 130 from the container 22 to the applicator pad 55'. As shown in FIG. 22, when the container 22 is received in the inlet bore 112, the distal extremity of the bottle neck 45 will be abutted against this abutment ridge 114. In such an embodiment, the abutment ridge 114 is annular in shape, having a central opening 159 defining a portion of the fluid communication path 130 for passing the fluid therethrough from the container 22 and its neck 45 to the flow chamber 71'.

As set forth in the above described embodiments and shown in the exemplary depiction at FIGS. 18-21, the inlet bore 112 may also be further formed in its proximal region with a plurality of lugs 162 spaced apart to define clearance slots 165 therebetween (such as shown in the exemplary embodiment of FIGS. 18-19) such that the studs 50 of the container neck 45 will be snapingly engaged behind respective lugs 162 (FIG. 21) in the bore 112 to secure the container 22 to the housing 70' and its coupling assembly 145'. While a snap lock connection has been described, it is further contemplated that any appropriate connection means, such as a threaded engagement or a clamp type connection, may also be employed to facilitate coupling of the container 22 to the dispenser housing 70'.

In operation, the user will secure the container 22 in the coupling assembly 145' of the dispenser housing 70' by aligning the yoke 33 and end wall 31 in the mounting socket 111 and seating the container neck 45 in the inlet bore 112 to thereafter inwardly advance the neck 45 through the inlet bore 112 in an alignment such that the locking studs 50 will be secured behind respective lugs 162 as set forth above. This will also result in the alignment of the mating curvilinear surfaces of the cowling 78 and the container end wall 31. As shown in FIGS. 22-23, by squeezing inwardly the walls of the container 22, a user will then cause the fluid therein to flow from the container reservoir 24, through the inlet bore 112 and bottle neck 45, and to the flow chamber 71', and more specifically, to the outwardly and forwardly angled rear portion of the introduction chamber 72. This initially directs the flow of fluid over the rear most array of slots 101 into contact with the longitudinally medial portion of the distribution plate 75', and will further effect flow through the second set of slots 102 for dispensation therethrough. Fluid flow will then continue to the more forwardly positioned slots 103. The fluid flow, under continued pressure from the squeezed container 22, will then continue forwardly and spread laterally across the forwardly disposed respective outlet edges 93 and 94 of the corresponding ribs 82 and 83 to flow laterally, outwardly and rearwardly into the respective flanking chambers 73, to then be driven rearwardly under pressure to flow over the slots 105 to thus dispense a measured modest amount of fluid to the lateral most portions of the distribution plate 75'.

Additionally, while FIG. 22 depicts the distribution plate 75' and bearing surface 76" as generally planar, it is also contemplated that these may be downwardly and outwardly curved in a concave manner and specifically designed to complementally receive the outwardly curving, convex outer surfaces of a wide variety of vehicle tires. In such a configuration, when the fluid is deposited on the distribution plate 75' from the introduction chamber 72, the concave curvature of the distribution plate 75' and surface 76" will further assist in promoting the fluid to flow towards the forward portion of the introduction-chamber 72 and into the flanking chambers 73.

Figure 31:
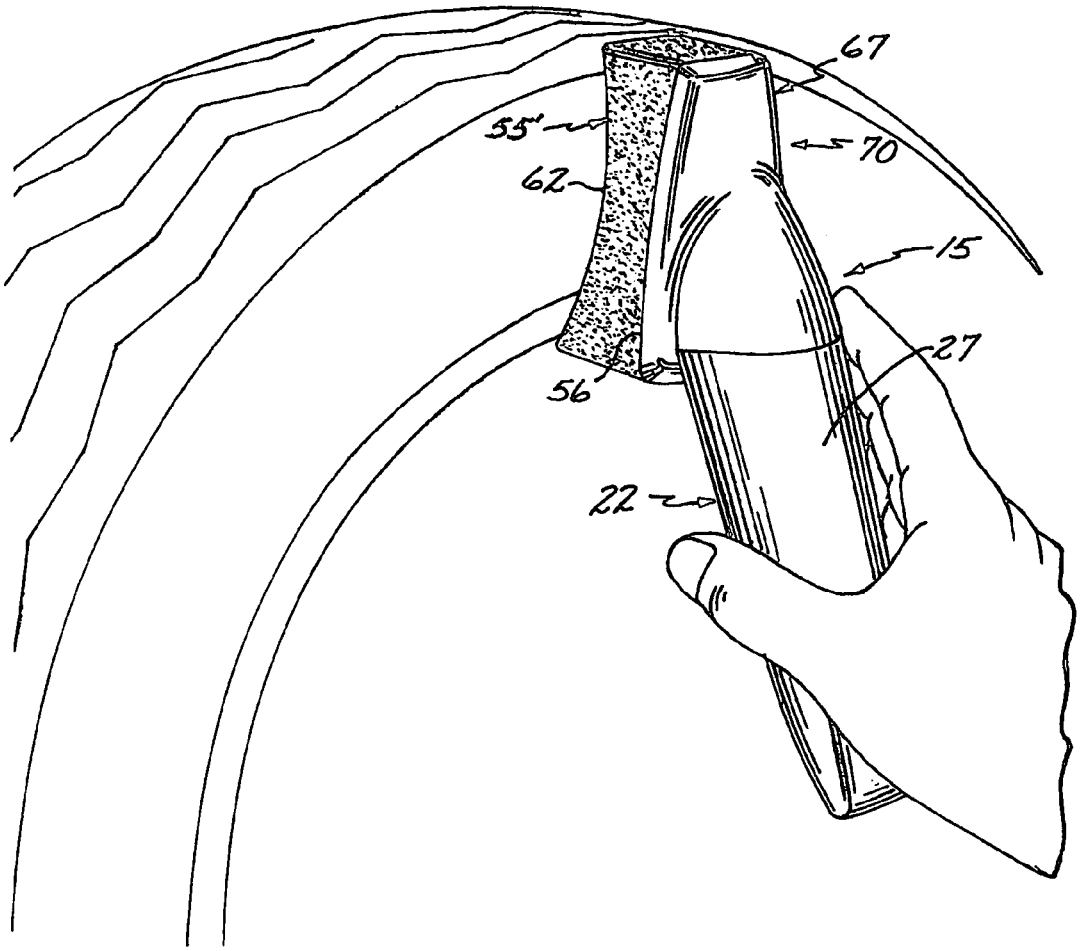
FIG. 31 is a perspective view, showing the applicator device of FIG. 12 in contact with a tire sidewall.

With reference to FIGS. 24 and 25, as the fluid is forced to the various slots 100-105 of the distribution plate 75', it then continues through such slots to distribution surface 76", which may be recessed and spaced apart from the applicator pad 55' to prevent occlusion of the slots. The fluid will then flow to the attachment surface 56 of the applicator pad 55', and then through the applicator pad or its through channels 59 to be dispersed on the applicator's concave working surface 62. The user then may pass the applicator head 67 across the surface to be treated thus applying the underside concave working surface 62 of the pad 55' to the complementally mating convex curving surfaces of a tire sidewall, as shown in FIG. 31. When the readily available supply of fluid at the working surface 62 has depleted, the user may thereupon squeeze the container 22 or otherwise again repeat the above described sequence. After treatment of a desired surface is completed, or the fluid in the container 22 has been exhausted, the user will disengage the container 22 from the housing 70 by twisting the container to axially rotate the yoke 33 and the coupling assembly 145' relative to one another. The flexibility of the cowling 78, yoke 33 and container end wall 31 will permit this limited axial rotation to skew the alignment between the cowling 78 and container end wall 31, which will serve to similarly axially rotate bottle neck 45 in inlet bore 112 to align the studs 50 with a corresponding clearance slot 165. The user may then withdraw the studs 50 through the clearance slots 165 to effectuate release of the container 22 from the housing 70', and replace the container 22 as set forth above.

Figure 32:
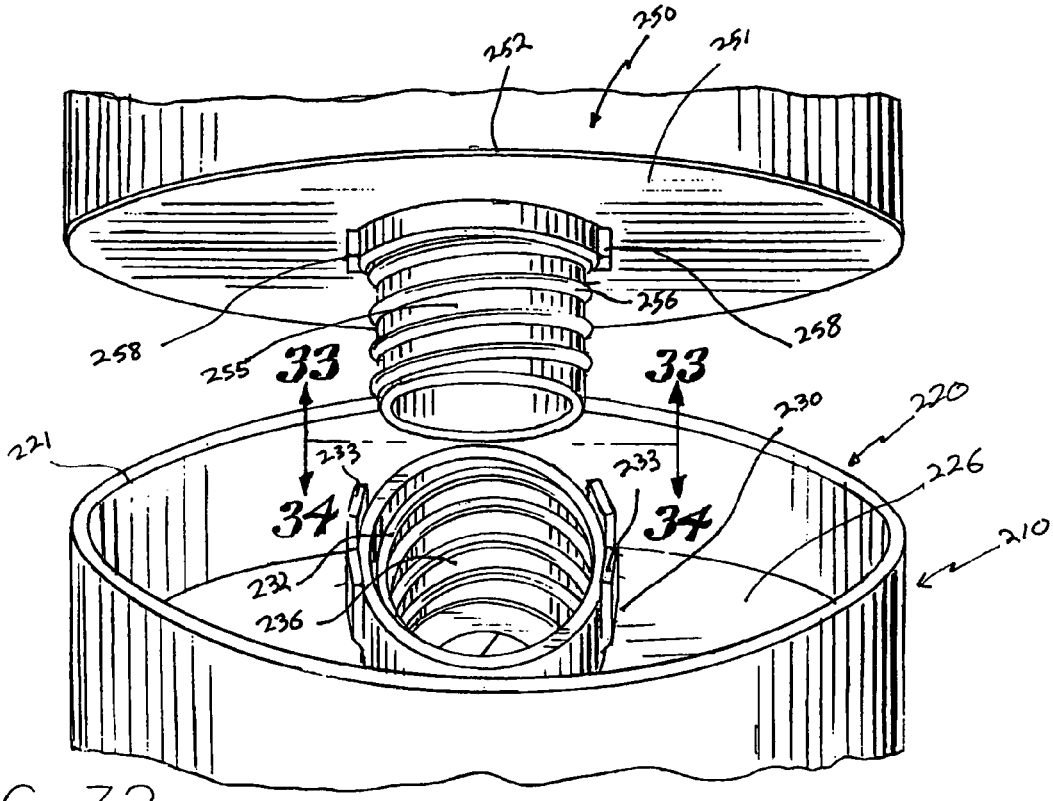
FIG. 32 is a perspective view of the connecting elements of a fourth embodiment of the applicator device of the present invention.
Figure 33:
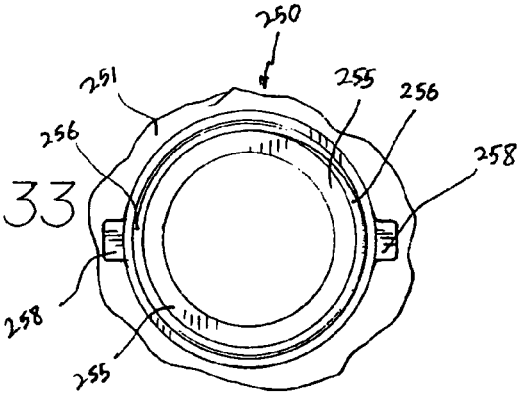
FIG. 33 is a partial bottom view of the container of the applicator device shown in FIG. 32, taken from line 33-33 of FIG. 32.
Figure 34:
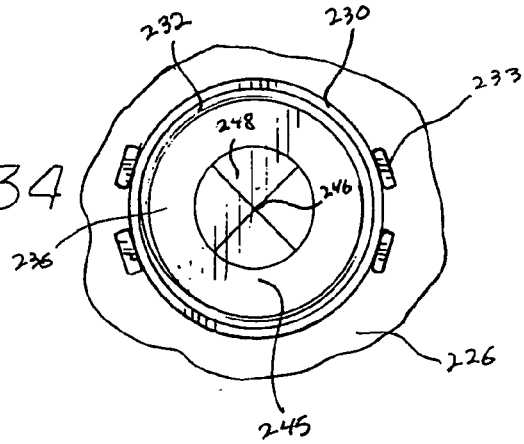
FIG. 34 is top partial view of the housing of the applicator device shown in FIG. 32, taken from line 34-34 of FIG. 32.
Figure 40:
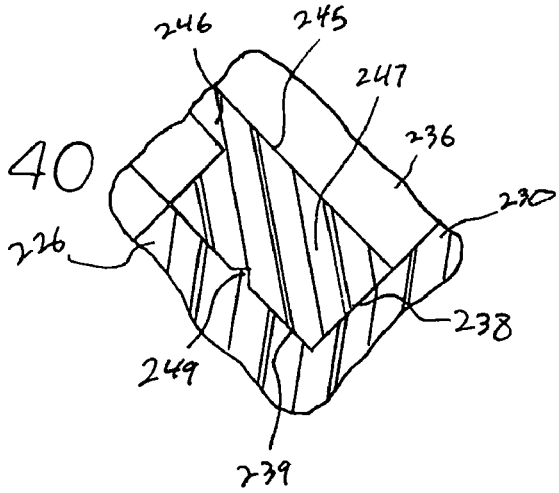
FIG. 40 is a detail sectional view, in enlarged scale taken from circle 40 of FIG. 35 depicting the flow control seated in the inlet cavity.
Figure 41:
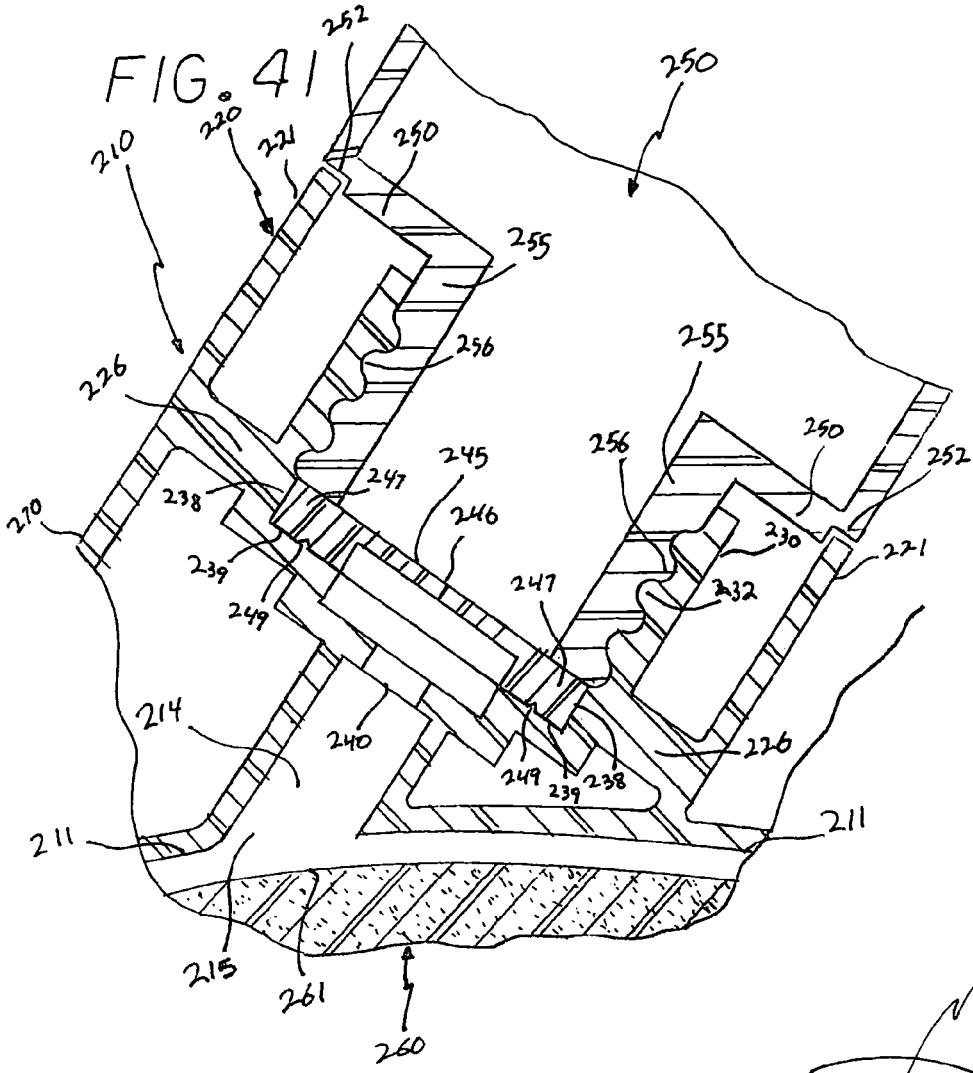
FIG. 41 is a longitudinal sectional view, in enlarged scale, of a portion of the coupling included in the device shown in FIG. 35.
Figure 42:
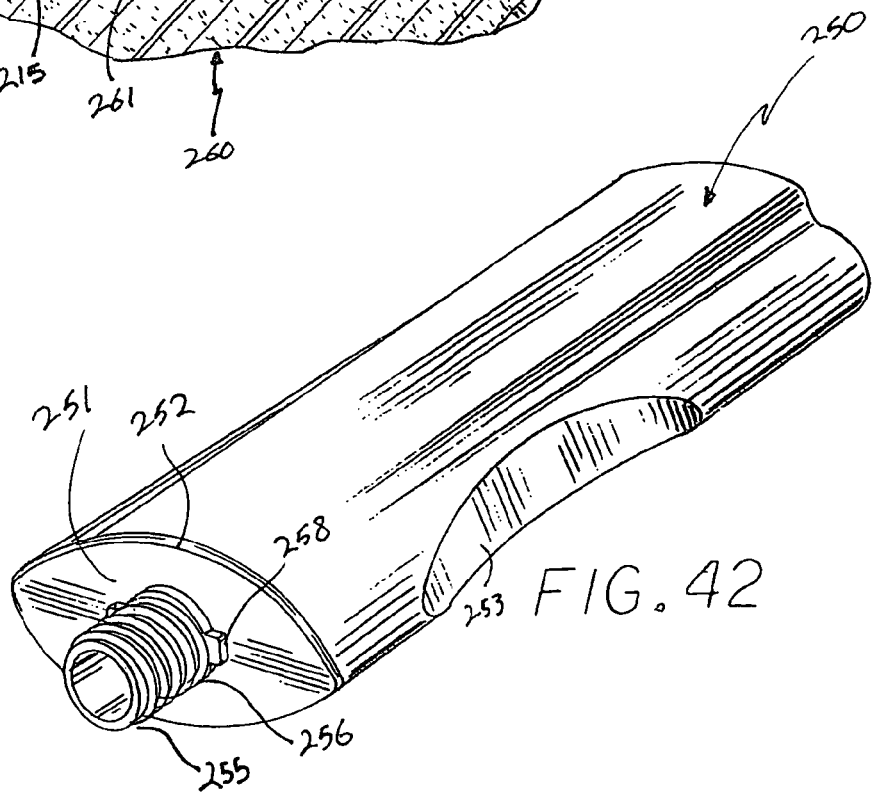
FIG. 42 is a perspective view, in an reduced scale, of the container shown included in the applicator device as shown in FIG. 32.

Referring to FIGS. 32-42, a fourth embodiment of the invention will now be addressed. This embodiment includes a housing 210 formed with a transverse wall 226 from which a coupling assembly 220 projects for receiving the neck 255 of an associated container 250. The coupling assembly includes an open ended axial inlet tube 230, as shown in FIG. 32, angling upwardly from the end wall 226 for complemental receipt of the male neck 255 of the container 250 (FIG. 42).

Figure 39:
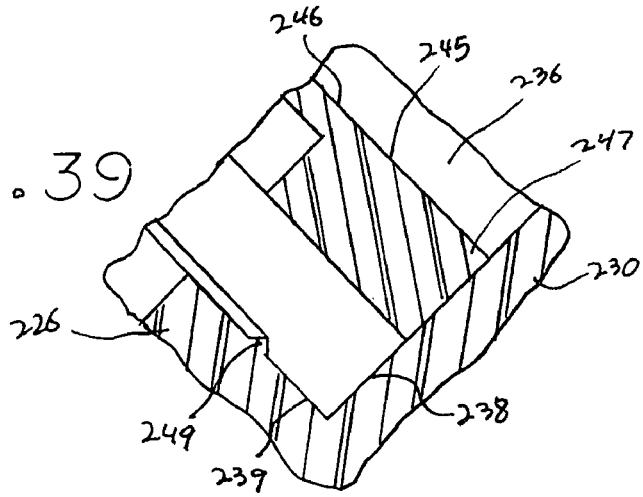
FIG. 39 is a detail sectional view, in enlarged scale taken from circle 39 of FIG. 35 depicting the flow control valve lifted off the gland.

As shown in the embodiment depicted in FIGS. 39-41, the coupling 220 is further formed in its bottom wall 226 with a central through inlet opening 240 surrounded by an annular gland 238 defining a rearwardly facing shoulder 239 configured with a raised annular sealing ridge 249. Nested in the gland is a flow control device 245, which may be in the form of a duck bill type one-way flapper valve 246, to control the flow of fluid therethrough to the central opening 240 and then to a flow chamber 214. The valve 246 is circumscribed by a compressible seal 247, and may be slightly domed rearwardly. The valve is also scored at 120° angles to define domed flaps 248, which open toward the inlet opening 240 in response to pressurized fluid flow to permit flow therethough. With this construction, the valve 246 also resists the return flow of fluid once it has passed through the flaps 248.

Figure 38:
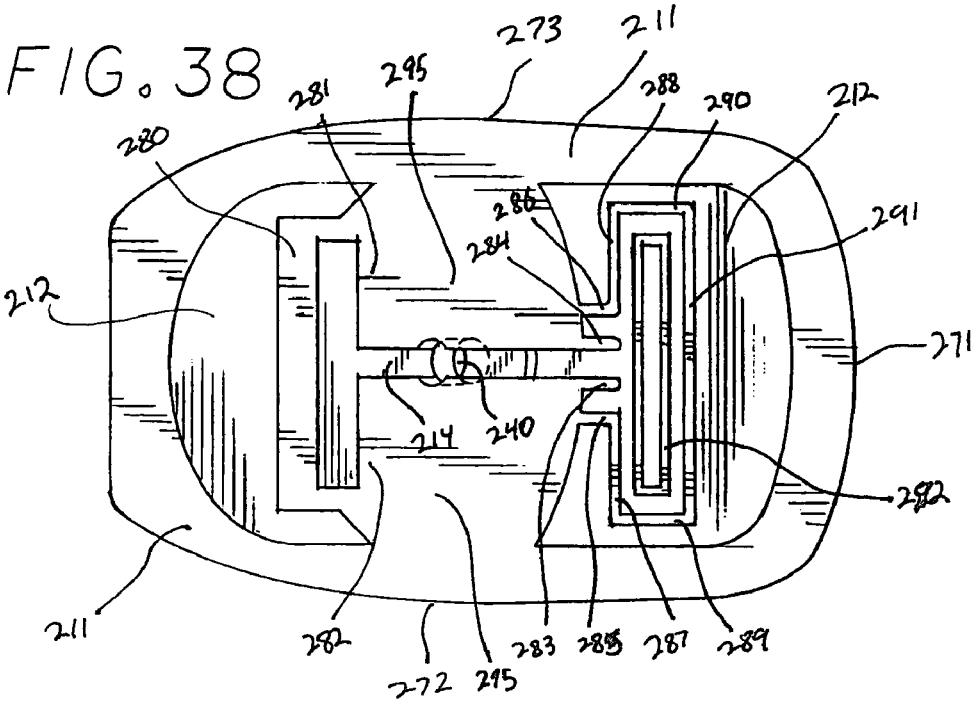
FIG. 38 is a partial horizontal sectional view, in reduced scale, of the applicator device shown in FIG. 35, depicting the housing bottom surface without the applicator pad affixed thereto.

Referring to FIG. 35, the housing 210 is formed with a rounded top wall 270, a rear wall 271 and side walls 272 and 273 that terminate at their lower extremities in a downwardly facing, upwardly concave, peripheral bearing surface 211, and may be internally formed with a central network of ribs and lightening holes. As shown in FIG. 38, the housing 210 further includes a plurality of vertically oriented, longitudinal and transverse chamber ribs, shown for example at 280-292. One pair of these ribs, 283 and 284, define the downwardly opening, elongated flow chamber 214 therebetween, with such chamber disposed in alignment with the opening 240 of the inlet 230. These ribs 280-292 terminate in downwardly facing bottom edges that cooperate with the bottom edges of the peripheral housing walls to define the bearing surface 211 providing a mounting surface to which the attachment surface 261 of the applicator pad 260 is affixed or otherwise mounted. As shown, for example in FIG. 35, the bottom edges of the housing walls and chamber ribs may cooperate to define a bearing surface 211 that is concave in shape to complement the convex curvature of a typical vehicle tire. When mounted to the bearing surface 211, the porous applicator pad receives fluid after it passes through the chamber 214 and chamber outlet 215 and distributes it along the pad's attachment surface 261 to be metered downwardly through the pores of the pad to the working surface 262. As shown in the embodiment depicted at FIG. 38, appropriately shaped and dimensioned pad mounting surface panels 295 may be incorporated into the bearing surface 211 to extend between the side walls, 272 and 273, and the centrally positioned ribs 283-286 to provide additional surface area to which the applicator pad 260 may be positively adhered.

Thus, as depicted in FIGS. 38 and 41, after the fluid passes from the flow control device 245 through inlet opening 240, it enters the flow chamber 214 to exit through a chamber outlet 215 to be pressurized against the attachment surface 261 of the applicator pad 260. In a preferred embodiment, the chamber defines an opening centrally in the bearing surface 211, and as fluid passes through the outlet 215, it is thus simultaneously distributed in intimate contact along the attachment surface 261 of the applicator pad 260 for communication therethrough to the pad's working surface 262.

The chamber ribs, e.g. 283-284, cooperate to define any appropriately shaped and configured flow chamber 214, chamber outlet 215 and distribution network for communicating and distributing fluid along the longitudinal and lateral dimensions of the applicator pad as may be desired for a given application. For example, as depicted in FIG. 38, the chamber ribs may further combine to define a flow network that can be generally described as "I" shaped, with the flow chamber outlet 215 defining the central section of the "I" and the remaining ribs defining the transversely projecting end sections.

The remaining portions of the housing bottom surface 211 may be formed with any economical or functional configuration desired. For example, the remainder of the bearing surface 211 may be solid, or may incorporate selected mounting surface panels 295 or additional chamber ribs to form any appropriate bottom surface pattern to provide surface area for bonding the attachment surface 261 of the pad 260 thereto.

As shown in FIG. 38, the housing bottom surface 211 may also be formed with a plurality of lightening cavities 212 conveniently situated about the periphery of the bottom surface and/or in the vicinity of the central portion adjacent to the chamber ribs 283 and 284. The cavities may be formed with varying and appropriate depths depending on the desired application and the financial and structural priorities established during the design and manufacturing processes. The contours of these cavities 212 may be defined by walls of varying convenient dimensions and orientations, and also terminate in bottom edges to cooperate in defining the bearing surface 211 to which the pad 260 is mounted.

The pad 260 is conveniently constructed in the form of semi-open cell polymer sponge like material, which can be either formed by injection molding or cut from a stock of foam, it only being important that it be self supporting and have sufficient porosity to restrict free flow of fluid while affording a metered flow therethrough to the working surface 261 for application to the tire sidewall, as shown in FIG. 31. The pad's dimensions and contours will be suited to a given application, and it may be oversized relative to the plan view of the bearing surface 211 to project laterally outwardly therefrom to form respective peripheral skirts.

To securely mount the container 250 in the housing 210 in a fluid tight sealing engagement, the container neck 255 and inlet 230 are formed with connector elements which preferably facilitate a threaded engagement, as shown in FIGS. 32, 35 and 41.

In this embodiment, the container 250 is oval in transverse cross section and the end wall 251 (FIGS. 41-42) includes a peripheral outwardly facing shoulder 252 and is formed centrally with the axial tubular neck 255 configured to be screwed into the open ended inlet tube 230 of the coupling assembly 220. The neck 255 is further formed with exterior screw threads 256, and is configured on the opposite sides of its base with a pair of diametrically outwardly projecting neck lugs 258. The opposite sides of the container 250 are preferably formed centrally along their length with longitudinal, outwardly opening concave depressions defining finger grips 253.

Figure 36:
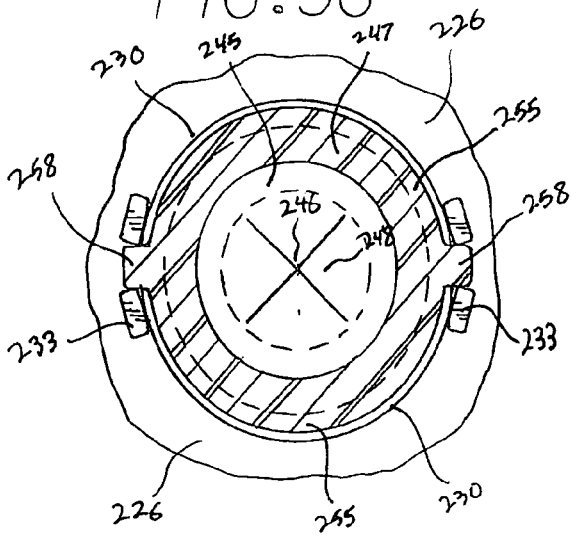
FIG. 36 is a transverse sectional view, in enlarged scale, taken along line 36-36 of FIG. 35.
Figure 37:
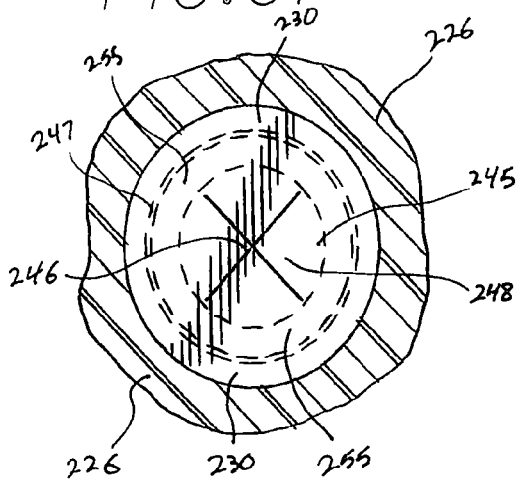
FIG. 37 is a transverse sectional view, in enlarged scale, taken along line 37-37 of FIG. 35.

For receiving the container 250 of this embodiment, as shown in FIGS. 32 and 41, the inlet tube 230 of the coupling assembly 220 is located centrally within the cowling 221 and configured with internal screw threads 232 for establishing a threaded engagement with the neck threads 256 of the container 250. The inlet 230 further includes pairs of axial, resilient catch fingers 233 extending upwardly beyond the top end of the inlet tube. Included in the embodiment of FIGS. 32 and 36 are two pairs of resilient fingers 233 situated on diametrically opposite sides of the tube, spaced circumferentially apart a distance sufficient to receive a stop neck lug 258 between the respective free ends and configured of a length to be contacted by the respective lugs 258 (FIGS. 32-34) as the neck 255 is screwed fully into the inlet tube 230 and the end thereof is engaged against and compressing the seal 247 (FIG. 41).

To enable mounting and locking of the container 250 into the inlet tube 230, as shown in the embodiment of FIGS. 32 and 41, the container neck 255 is screwed into the inlet tube 230 and, upon rotation of the container 250 clockwise, the neck will be drawn into the inlet tube 230. Upon continued rotation and threaded mating, the neck 255 is advanced axially inwardly in the inlet tube 230 until the open end of the neck is abutted against the annular seal 247, and as the seal is compressed, the neck lugs 258 will engage the free ends of the respective counter clockwise most fingers 233 to flex the engaged free ends to, as rotation continues, cam therepast to register the lugs 258 between the respective finger pairs of fingers 233, as shown in FIG. 36, to alert the operator that sealing contact has been made.

With the lugs 258 registered between the finger pairs 233, the user can be assured the open end of the neck 255 is seated against the compressible annular seal 247 and the fingers 233 will resist rotation in either direction to thus maintain effective sealing engagement and avoid over tightening the mating engagement between the threads of the container neck and inlet. To release the container from its engagement with the inlet, the user will simply rotate the container counter clockwise to initially cause the lugs 258 to orbit to flex and clear the respective clockwise most fingers 233 in the opposite direction from that described above, whereupon continued rotation will cause the neck threads 256 to disengage their threaded engagement with the inlet threads 232 and the container 250 may be removed from the housing 210.

In operation, for the embodiment shown in FIGS. 32-42, the container is constructed to contain at least 8 fluid ounces of automotive appearance fluid and will typically be sold filled with tire treatment fluid and the neck sealed by a removable aluminum seal. The container may be unscrewed from the housing, the typical aluminum seal removed and the container neck 255 screwed into the inlet tube 230. Rotation of the container and mating of the threads will advance the neck into the tube until the neck is abutted against the seal 247 (FIG. 35), at which time the neck lugs 258 are registered between the inlet's corresponding pairs of fingers 233 to resist further rotation and the cowling 221 is registered against the shoulder 252 of the container end wall 251.

Referring to FIGS. 35 and 41, by squeezing inwardly on the walls of the container 250, a user will force the fluid from the container, through the container neck 255 and inlet tube 230, through the valve 246, through the inlet opening 240 of the gland 238, to the flow chamber 214 and out the outlet 215. The pressurized fluid is forced from the outlet 215 to be forced against and through the thickness of the applicator pad 260 to the working surface 262.

After treatment of the tire is complete, or the fluid in the container 250 has been exhausted, the user may disconnect the container 250 from the housing 210 by rotating the container counter-clockwise until the neck lugs 258 are disengaged from their registration between the fingers 233. Continued rotation will withdraw the neck 255 out of the cavity 236 of the inlet tube 230 as the neck threads 256 disengage the inlet threads 232. This will release the container 250 from the housing 210, and the user may then replace the container 250 or refill it for subsequent applications.

While the inlet 230 has been described as tubular, as will be appreciated by those of skill in the art, the inlet 230 and the mating neck 255 may take many different forms so long as they are configured for complemental mating, even to the extent of the chamber inlet being a neck and the container including a socket to receive the neck. Additionally, it is further contemplated that the neck 255 of container 250 may abut directly against the gland 238 and be seated in seat 239 when the neck is received in the inlet if the flow control device 245 is located elsewhere along the fluid communication path leading from the container 250 to the applicator pad 260. Moreover, while the above described chamber ribs have been described as defining an exemplary flow chamber 214 and network of channels for distributing fluid, this is instructive of the manner in which the flow chamber 214 and bearing surface 211 can cooperate to direct fluid both longitudinally and laterally to the applicator pad's attachment surface, but is merely one contemplated configuration for accomplishing this objective. Additionally, while a single flow chamber 214 has been described in this embodiment, it is further contemplated that the housing 210 may include multiple flow chambers, or that individual chambers may be segmented into sub-chambers.

In a fifth embodiment depicted in FIGS. 43-46, a container 350 includes an end wall 351 configured centrally with an axial neck 355 formed with an exterior annular, conical flange 356 that slopes axially and radially outwardly to define a rearwardly sloping cam surface 357 that terminates in a rearwardly facing, annular locking shoulder 358.

Figure 43:
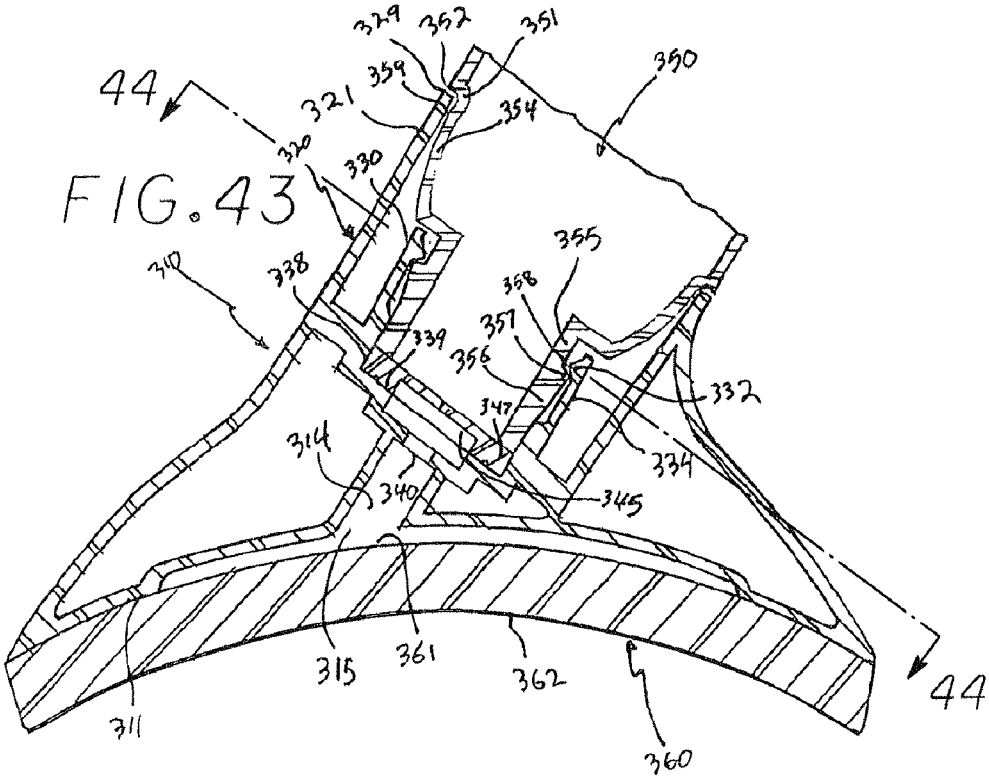
FIG. 43 is a partial longitudinal sectional view of a fifth embodiment of the applicator device of the present invention.
Figure 44:
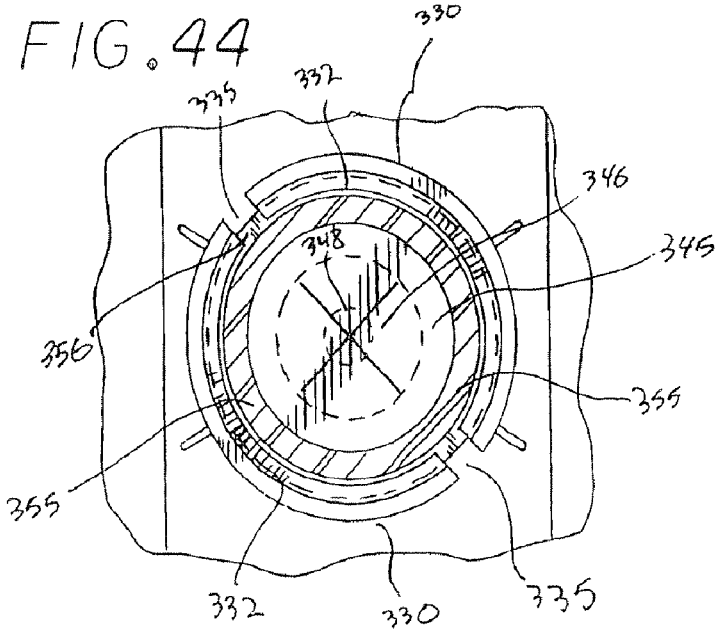
FIG. 44 is a transverse sectional view, in an enlarged scale, taken along the line 44-44 of FIG. 43.
Figure 45:
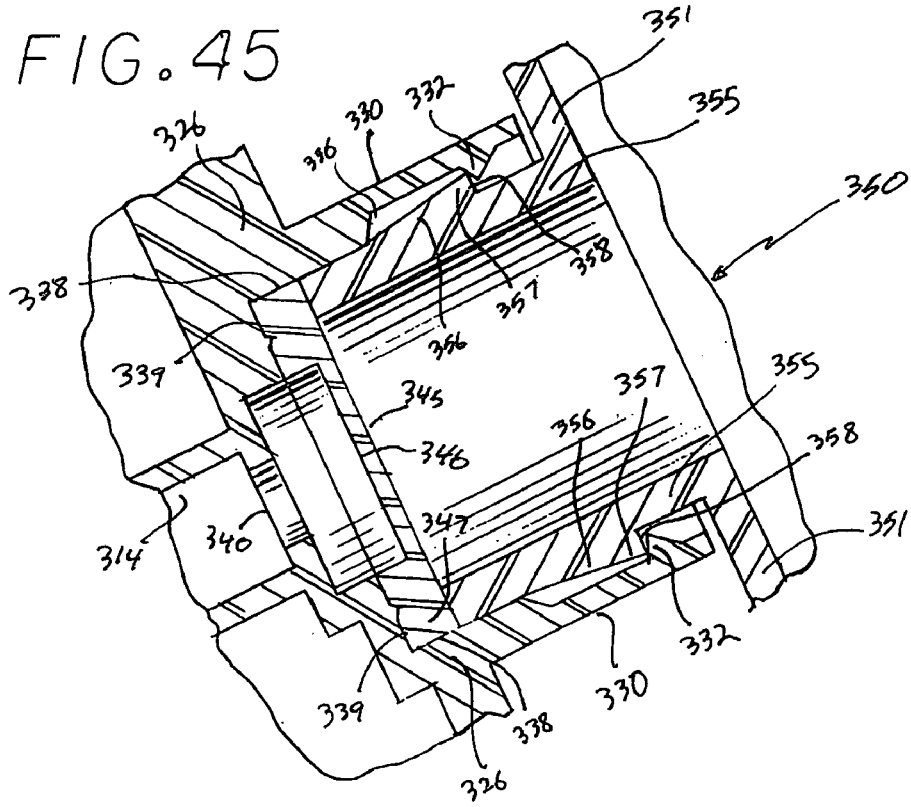
FIG. 45 is a longitudinal sectional view, in an enlarged scale, of a portion of the coupling included in the device shown in FIG. 43.
Figure 46:
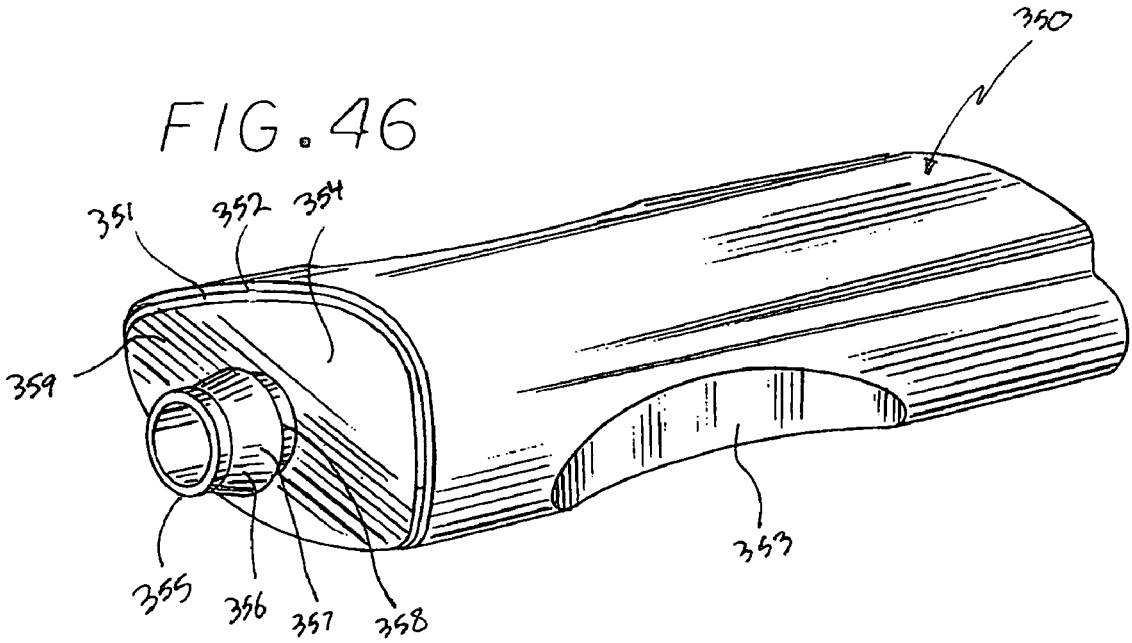
FIG. 46 is a partial perspective view, in an reduced scale, of the container shown included in the applicator device as shown in FIG. 43.

For receiving the container 350 of this embodiment therein, as shown in FIGS. 43 and 45, the housing 310 includes a coupling assembly 320 formed with an open ended cowling 321 having a rear edge 329 configured to establish a nesting relationship with a shoulder 352 of the container end wall 351 when the container is received in the coupling assembly 320.

In the embodiment of FIG. 43, the open ended cowling 321 is bisected by the inlet tube 330 and configured with an oval in cross section periphery to compliment the oval cross sectional shape of the container 350. The free ends of the cowling 321 are formed on the opposite sides, corresponding with the minor axis of the oval shape, with upwardly raised curved tongues 329, similar to the curved tongue shown in FIG. 3, such that the distally extending curved ends 329 of such cowling walls may act as caming surfaces for a purpose to be disclosed hereafter.

The centrally located inlet tube 330 angles upwardly in the inlet housing and is segmented to form cantilever mounted, upstanding, diametrically opposed, resilient clam shell type half tubes 334 separated by spaces 335, each configured on their interior with respective radially inwardly projecting semi-circular, V-shaped, in axial cross section, bead segments 332 disposed a selected distance from the bottom wall of 339 of a valve gland 338. Formed centrally in the bottom wall is an inlet 340 leading to the chamber 314 which introduces flow from the chamber opening 315 to the top side 361 of the applicator pad 360 for communication therethrough to the pad's working surface 362. The gland 338 receives a resilient valve 345 configured with a peripheral annular compressible seal 347 configured on its bottom side with an annular downwardly opening groove for receipt of a upwardly raised, complementally shaped, annular rib formed in the gland seat 339.

The container 350 is formed with a central container neck 355 and an end wall 351 which is stepped down peripherally at 352 and includes a domed yoke 354, similar to yoke 33 shown in FIG. 30, configured at the opposite ends of its major axis with rounded shoulders to be received partially into the cowling 321. The yoke 354 is configured such that its rounded shoulders form curved cam surfaces 359 so that, when coupled as shown in FIG. 43 and the container is rotated about its longitudinal axis, such shoulder will ride upwardly on the curved ends 329 of the cowling 321 to drive the container axially away from the applicator housing. This draws the flange 356 axially away from the applicator pad, thereby applying axial and radially outwardly forces to the beads 332, and consequently the free ends of the tube segments 334, to drive the free ends away from one another to thus force the respective beads 332 clear of the path of flange 356 for disengagement of the container from the applicator housing.

On the other hand, when the container 350 is to be coupled with the applicator housing, the neck 355 may be inserted axially into the space between the respective tube segments 334 to engage the conical cam surface 357 of the flange 356 with the bead segments 332 to flex the free ends of the tube segments away from one another allowing the flange 356 to be received under the respective beads 332 and to be drawn axially inwardly by the conical cam shape of the respective cross sectional profile of such beads to compress the end of the neck against the compression seal 347 to form a compressive seal.

In the embodiment of FIGS. 43-46, the remaining construction does not differ significantly from that depicted in FIGS. 32-42. For example, FIG. 43 depicts a housing construction having a flow chamber 314 aligned with inlet opening 340 similar to the embodiment of FIG. 35, which includes a chamber outlet 315 opening onto the attachment surface 361 of pad 360 for communication of fluid therethough to working surface 362. The housing 310 may be similarly formed with housing walls, lightening cavities and chamber ribs whose bottom edges terminate to define a bearing surface 311 to which the pad 360 is attached.

While squeeze dispensing embodiments of the container 22, 250 and 350 have been described in detail, it is also in keeping with the invention to choose a material for the container having relatively more rigid walls, thereby requiring the user to vertically elevate the container and handle portion of the applicator above that of the housing in order to initiate the flow of fluid into the housing and applicator pad. Further, the handle may not necessarily be defined by the container, but may be formed as one of two or more components. For example, the handle may be in the form of an open top channel shaped member, while the container may be in the form of a flexible bottle, tube or other packaging devices readily known to those skilled in the art wherein the volume can be varied as by flexing the wall or rolling up the tube or depressing a plunger.

While several particular forms of the invention have been illustrated and described, it will also be apparent to those skilled in the art that various modifications can be made without departing from the spirit and scope of the invention. Accordingly, it is not intended that the invention be limited except by the following claims.

What is claimed is:

1. A vehicle tire fluid applicator device for mounting to a flexible wall fluid container of the type having a downwardly opening container outlet and a container coupling for applying tire fluid to a curved side wall of a tire, the applicator device comprising:

a housing including top and side walls cooperating to define a flow passage leading to a flow chamber formed with a central downwardly opening chamber outlet and a concave curved downwardly facing peripheral bearing surface surrounding the outlet;

the housing being further configured in its upper portion with a housing coupling device for releasably coupling to the container coupling and including an inlet configured to mate with the container outlet;

an elongated porous applicator pad affixed on its top side to the bearing surface and covering the outlet, the pad formed on its bottom side with a working surface and configured of a construction and thickness to, when the container wall is pressed, eject the tire fluid to the flow chamber and through the pad to the working surface; and a flow control device for selectively restricting flow of the fluid from the container to the chamber whereby a user may couple the container to the housing coupling and grasp the housing to press the bearing surface against the pad to press the working surface against the curved side wall so that, while compressing the flexible walls of the container to expel the fluid through the passage and flow control device to the chamber, through the chamber outlet to the applicator pad and through the pad to the working surface, the user presses the bearing surface to maneuver the working surface about the curved sidewall.

2. The applicator of claim 1 wherein:

the inlet includes a fluid seal against which the container outlet is adapted to be seated to form a fluid tight seal between the container and the housing.

3. The applicator of claim 1 for connection with a container formed with a neck defining the container outlet and wherein:

the inlet includes a tube connected with the chamber configured to releasably receive the neck and including a seal adapted to cooperate with the neck to form a fluid tight seal.

4. The applicator of claim 3 for connection with a container having a neck formed with exterior screw threads and wherein:

the inlet tube includes internal screw threads adapted to cooperate with the exterior screw threads.

5. The applicator of claim 3 for connection with a container wherein the neck is formed around its periphery with a continuous collar having a peripheral surface which tapers rearwardly and outwardly to define a peripheral cam surface and wherein:

the inlet tube includes an interior bead configured to, upon the neck being inserted in the tube, engage the peripheral cam surface and, upon further insertion, to ride outwardly and rearwardly relative thereto to engage therebehind.

6. The applicator as set forth in claim 5 wherein:

the inlet is formed on its forward end with a shoulder defining a rearwardly facing seat and the bead is spaced from the forward end of the neck a distance sufficient to, when the bead is engaged behind the collar, urge the open end of the neck against the seat to cooperate in forming a fluid tight seal.

7. The applicator as set forth in claim 6 wherein the flow control device includes a compression ring nested against the seat such that the open end of the neck is urged against the compression ring to form the fluid tight seal.

8. A tire fluid applicator device including:

an applicator housing including a top wall and side walls turned downwardly and terminating in a downwardly facing, concave bearing surface;

chamber means forming a chamber;

inlet means to receive fluid flow into the chamber;

outlet means in the bottom of the chamber to flow fluid out of the chamber;

container means for containing fluid and container outlet means for flowing fluid out of the container means to the inlet means;

coupling means for releasably coupling the container to the applicator housing;

means for forcing fluid from the container means into the chamber; and applicator pad means covering the chamber outlet means and including a downwardly facing working surface to be rubbed over a surface of a tire to be treated with the fluid while the pad means resistingly controls the flow of fluid from the chamber outlet means, though the pad to the working surface.

9. A tire fluid applicator device for applying treatment fluid to the convex curved side wall of a tire comprising:

a hand held container for containing a treatment fluid and including a forwardly opening container outlet;

an applicator housing formed by top and side walls and configured with a flow chamber having a downwardly opening chamber outlet, a rearwardly opening inlet communicating with the container outlet and a downwardly facing, concave curving bearing surface;

a porous applicator pad mounted on the bearing surface and covering the chamber outlet to restrictively meter fluid flow from the chamber outlet through the body of the pad to distribute flow to at least a portion of the area of an underside working surface of the pad; and a coupling device including a first coupling element on the container and a second coupling element on the inlet for releasably coupling the container to the applicator housing.

10. The applicator device of claim 9 that includes:

a flow control device for restricting fluid flow from the container to the chamber.

11. The applicator device of claim 9 wherein;

the first and second coupling elements are in the form of screw threads.

12. The applicator of claim 11 wherein:

the container is formed with a neck defining the container outlet; and the housing is formed with a tube defining the inlet and further includes a rearwardly facing shoulder and a compression seal on the shoulder configured to form a fluid-tight seal between the container and the housing when the neck is received in the tube and seated against the seal.

13. The applicator of claim 12 wherein:

the coupling device includes a resilient catch device responsive to the neck being screwed a predetermined distance into the tube to engage and resist unscrewing of the container from the housing.

14. The applicator of claim 12 wherein:

the container includes at least one lug; and the housing includes at least one finger for, upon the neck being screwed a predetermined distance into the tube, releasably engaging the lug to restrict rotation of the container relative to the tube.

15. The applicator of claim 12 wherein:

the container includes a pair of lugs; and the housing includes two pairs of resilient fingers projecting from the tube to, upon the neck being screwed a predetermined distance into the tube, engage respective ones of the lugs and, upon further screwing of the neck into the tube, to flex to clear the respective lugs so the respective lugs will be positioned between the respective pairs of fingers to restrict rotation of the container relative to the housing.

16. The applicator of claim 9 wherein:

the container is constructed to contain at least 8 fluid ounces of automotive appearance fluid.

17. A tire applicator for applying treatment fluid to the curved surface of a tire sidewall comprising:

a housing formed with a concave housing bottom surface, a flow chamber having a downwardly opening outlet opening into the bottom surface and a coupling assembly that includes an inlet to the chamber and a first connector element;

a porous applicator pad mounted on the housing bottom surface and formed with a working surface, the pad being disposed over the outlet for receiving fluid from the outlet and being further configured to meter the flow of fluid therethrough to the working surface;

a container including an outlet neck and a second connector element for connecting with the first connector element to releasably connect the container to the housing and to further establish a fluid communication path including the container, the outlet neck, the inlet, the flow chamber and the outlet; and a flow control device positioned along the fluid communication path for regulating the flow of fluid therethrough.

18. The applicator of claim 17 wherein:

the flow chamber and outlet are configured to distribute the fluid longitudinally along the pad for communication therethrough to the working surface.

19. The applicator of claim 18 wherein:

the chamber and outlet are further configured to distribute the fluid laterally along the pad.

20. The applicator of claim 17 wherein:

the first connector element and the second connector element are defined by respective screw threads configured for mating rotational engagement.

* * * * *